United States Patent [19]

Ishikawa et al.

[11] Patent Number: 4,811,048

[45] Date of Patent: Mar. 7, 1989

[54] COPYING APPARATUS HAVING AN AUTOMATIC DOCUMENT FEEDER AND A SORTER WITH A SHEET BINDING FUNCTION

[75] Inventors: Takuma Ishikawa; Kuniaki Ishiguro, both of Toyokawa, Japan

[73] Assignee: Minolta Camera Kabushiki Kaisha, Osaka, Japan

[21] Appl. No.: 136,747

[22] Filed: Dec. 22, 1987

[30] Foreign Application Priority Data

Dec. 27, 1986 [JP] Japan ..... 61-313251
Dec. 27, 1986 [JP] Japan ..... 61-313252

[51] Int. Cl.[4] ..... G03G 15/00
[52] U.S. Cl. ..... 355/14 SH; 355/3 SH
[58] Field of Search ..... 355/14 SH, 14 R, 3 SH; 270/53, 37, 38

[56] References Cited

U.S. PATENT DOCUMENTS

| | | | |
|---|---|---|---|
| 3,944,207 | 3/1976 | Bains | 270/58 |
| 4,076,408 | 2/1978 | Reid et al. | 355/14 SH |
| 4,145,037 | 3/1979 | Mol | 270/58 |
| 4,227,275 | 10/1980 | Söderberg | 227/44 X |
| 4,248,525 | 2/1981 | Sterret | 355/14 SH |
| 4,361,393 | 11/1982 | Noto | 355/3 SH |
| 4,411,515 | 10/1983 | Kukucka et al. | 355/14 Sh |
| 4,473,425 | 9/1984 | Baughman et al. | 355/14 SH |
| 4,549,804 | 10/1985 | Braun et al. | 355/14 SH |
| 4,564,185 | 1/1986 | Hamlin et al. | 270/53 |
| 4,566,782 | 1/1986 | Britt et al. | 355/14 SH |
| 4,582,421 | 4/1986 | Hamlin et al. | 355/14 SH |
| 4,626,156 | 12/1986 | Baughman et al. | 355/14 SH |
| 4,647,034 | 3/1987 | Sawa | 271/293 |
| 4,674,866 | 6/1987 | Tanaka | 355/14 SH |
| 4,687,191 | 8/1987 | Stemmle | 270/53 |

FOREIGN PATENT DOCUMENTS

| | | |
|---|---|---|
| 99250 | 1/1984 | European Pat. Off. . |
| 57-72537 | 6/1982 | Japan . |
| 57-131667 | 8/1982 | Japan . |
| 60-248563 | 9/1985 | Japan . |
| 61-145069 | 7/1986 | Japan . |

*Primary Examiner*—R. L. Moses
*Attorney, Agent, or Firm*—Burns, Doane, Swecker & Mathis

[57] ABSTRACT

A copying apparatus having image forming means, an automatic document feeder, sorting means for distributing copying sheets having an image formed thereon among a plurality of bins and means for binding the sheets contained in each bin. When a binding mode is selected by using the automatic document feeder, the operation of the binding means is started when a specified time has passed since all the documents were fed from a document tray. Moreover, when an instruction to start operating the binding means is entered during the operation of the image forming means, the operation of the binding means is started after completing the operation of the image forming means.

3 Claims, 32 Drawing Sheets

COPYING APPARATUS HAVING AN AUTOMATIC DOCUMENT FEEDER AND A SORTER WITH A SHEET BINDING FUNCTION

BACKGROUND OF THE INVENTION

1. Field of the Invention

The present invention relates to a copying apparatus, more particularly, having an automatic document feeder and a sorter so that the sheets carrying the images transcribed by a copying machine can be distributed and bound accordingly after being ejected from the copying machine.

2. Description of the Prior Art

Recently, responding to the increasing demand for automatized paper handling system for the copying machines, the optional systems such as the automatic document feeding system and the sorting system designed for sorting or grouping the duplicate sheets have been developed and commercialized in various types one after another. The users of the copying machines are now requiring the sorter-finisher system capable of automatically binding and stacking the duplicate sheets which have been distributed and stocked in the sorting system, and this type sorter-finisher system has already been commercialized for some of large-sized copying machines.

For example, those publicized in U.S. Pat. No. 3,944,207, issued Mar. 16, 1976 to Bains, U.S. Pat. No. 4,549,804, issued Oct. 29, 1985 to Braun et al., U.S. Pat. No. 4,248,525, issued Feb. 3, 1981 to Sterret, U.S. Pat. No. 4,411,515, issued Oct. 25, 1983 to Kukucka et al, and European Patent Publication No. 99,250, are known as the sorter-finisher system falling under said category.

This type of sorter, which is provided with a finisher, is so designed that upon completing the sorting operation, the finishing operation is started in order to staple the sorted sheets. However, it is difficult to automatically judge the timing when the sorting operation is completed. Therefore, it is proposed that such a sorter be provided with a special switch to start the finishing operation, wherein said switch will have an arrangement whereby the finishing mode operation is started by input with the switch. This type of start switch is, needless to say, necessary for the operation of similar sorters. However, since only the start switch can start the finishing mode operation, an operator is necessary to operate the switch, and further, operation involving an operator has the inherent problem of inevitably causing dead time.

Additionally, when means for starting of finishing is activated by mistake while the copying operation is in progress in the finishing mode in which the stapling operation is executed by using an automatic document feeder, there is a problem that the stapling operation is started before the duplication of all the document is completed.

SUMMARY OF THE INVENTION

Therefore, one object of the present invention is to provided a copying apparatus characterized in that, when a binding mode is selected to execute a sheet binding operation by using an automatic document feeder, the operation of binding means is started when a specified time has passed since all the documents were fed from a document tray of the automatic document feeder.

Another object of the present invention is to provide a copying apparatus characterized in that, when an instruction to start operating the binding means is entered during the operation of image forming means, the operation of the binding means is started after completing the operation of the image forming means.

Therefore, in the case of the copying apparatus according to the present invention, when a specified time has passed after all documents were fed from the document tray of the automatic document feeder, and it is judged that the copying and sorting operations for the set of documents are completed, the operation of the binding means is started. Accordingly, in order to execute the binding operation by using the automatic document feeder, and when only the proper mode is designated among various modes in starting the copying operation, the other procedure is automatically performed.

Further, when the instruction to start the operation of the binding means is entered while the image forming means is not in operation, the operation of the binding means is promptly started. On the other hand, when the instruction to start the operation of the binding means is entered while the image forming means is in operation, the operation of the binding means is started after completing the operation of the image forming means. Accordingly, it is made possible to positively prevent a problem wherein, while the copying operation is in progress by using the automatic document feeder, the operation of the binding means is started by mistake before completing the duplication of all the documents and further, if only an instruction to start the operation of the binding means is entered by an operator while the image forming is in operation, all the other procedures are automatically performed for executing binding operation.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Embodiments of the present invention will be described below with reference to the drawings.

Composition of Whole System

Figure 1:
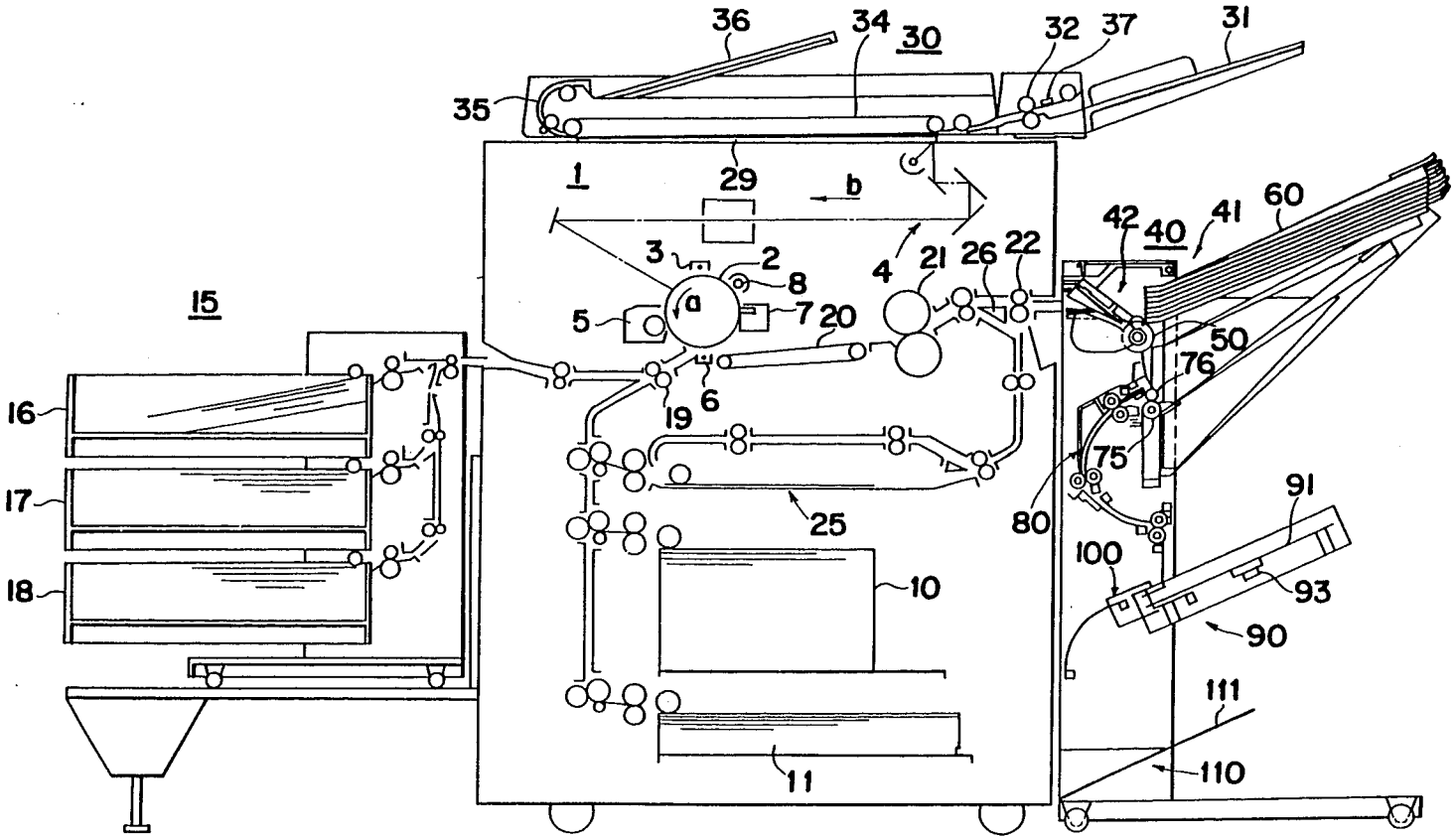
FIG. 1 is a schematic block diagram showing a copying machine and a sorter-finishing system.

A sorter-finisher system 40 relating to the present invention is designed to be installed on the side of copying machine 1 as shown in FIG. 1, and the copying machine 1 is provided with an automatic paper feeding unit 15 and an automatic document feeding unit 30 (hereinafter referred to as ADF).

The copying machine 1 operates on the principle of the commonly known electrophotography. In this copying machine 1, a photosensitive drum 2 to be turned towards the direction of an arrow a is charged with a certain amount of static electricity by as static electricity charger 3, and the document set to the specified position by ADF 30 is exposed to the light through a slit when the optical system 40 scans the document towards the direction of an arrow b. This causes the electrostatic latent image formed on the photosensitive drum 2 to be developed into the toner image by the magnetic brush type developing device 5 and then transferred onto the sheet by transfer charger 6.

The sheet fed one by one selectively from the elevate type and cassette type automatic paper feeders 10 and 11 built in the copying machine 1 or the 3-stage paper feed cassettes 16, 17 and 18 of the automatic paper feeder 15 installed outside the copying machine 1 is transported to the transferring portion by a timing roller couple 19 with specified timing. The sheet carrying the copied image is delivered to fixing unit 21 by conveyor belt 20 for fixing the toner image. Then, the sheet is transported to the sorting unit 41 by ejection roller couple 22 while the passage of the sheet is detected by ejection switch SW3 (Refer to FIG. 2) provided immediately before the ejection roller couple 22. The copying machine 1 has a built-in paper re-feeder 25, which enables duplex copy and composite copy, and a sheet transfer selection click 26 is provided before the ejection roller couple 22.

On the other hand, the photosensitive drum 2 continues to turn towards the direction of the arrow a even after the image is transferred so that the residual toner can be removed by a blade-type cleaner 7, and simultaneously the residual electrostatic charge is erased by an eraser lamp 8 in order to prepare for the next copying operation.

The ADF 30 itself is commonly known and designed to feed the documents placed on the document tray 31 one by one using the feed roller couple 32 and is set to the specified position on a glass member 29 of document rest by the rotary motion of the conveyor belt 34. After the exposure of the image, the document is ejected onto the ejection tray 36 through transfer pass 35 as conveyor belt 34 turns.

Figure 2:
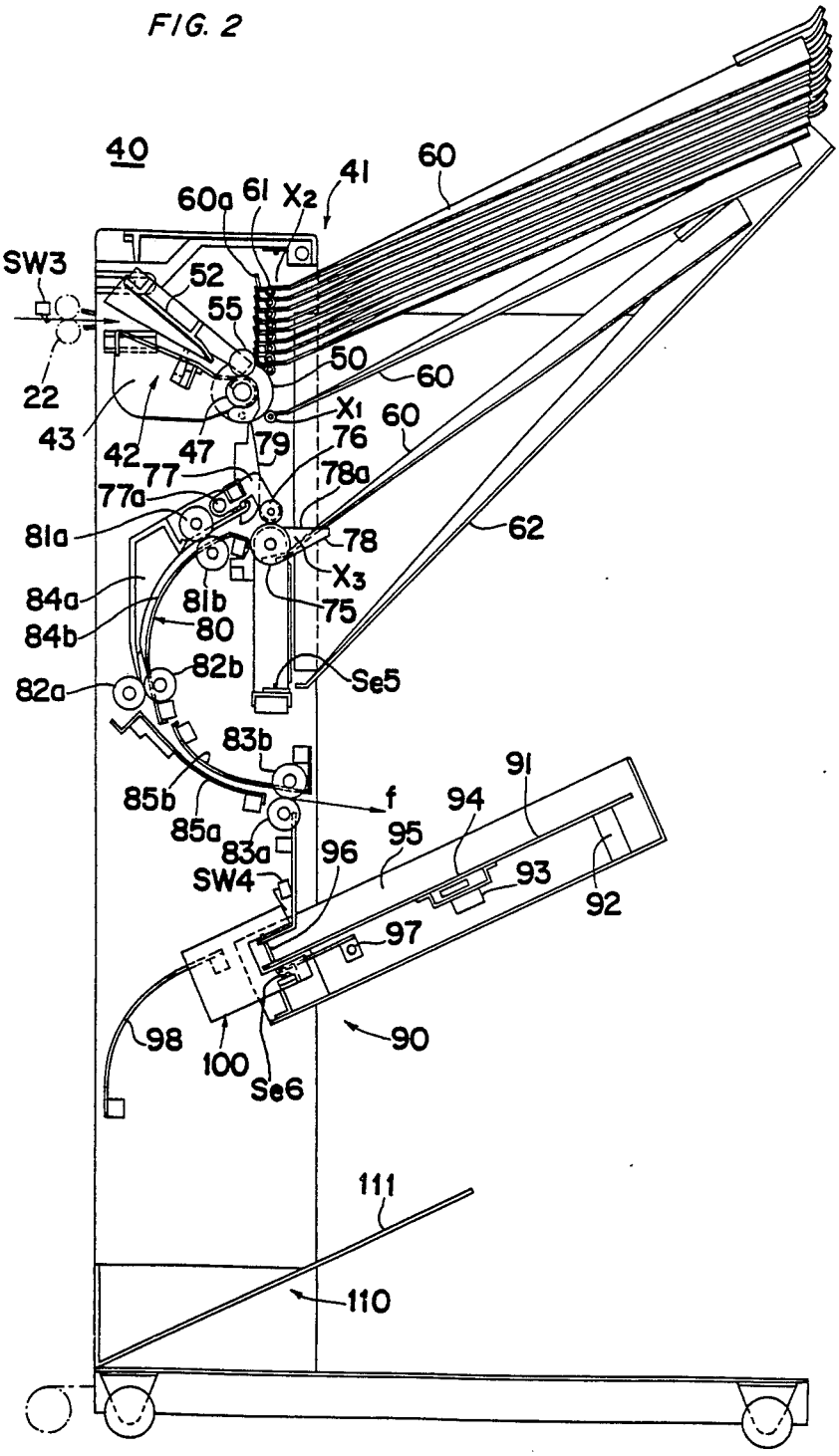
FIG. 2 is a internal composition of the sorter-finisher system.

As shown in FIG. 2, the sorter 40 comprises a sorting unit 41 for distributing the sheets among the bins 60, a stapling unit 90 with a stapler 100 for binding the sheets and a stacking unit 110 for stacking the stapled sheets. In this sorter 40, the stapling unit 90 is disposed below the sorting unit 41, and the stacking unit 110 is disposed below the stapling unit 90.

Composition and Operation of Sorting Unit

Figure 3:
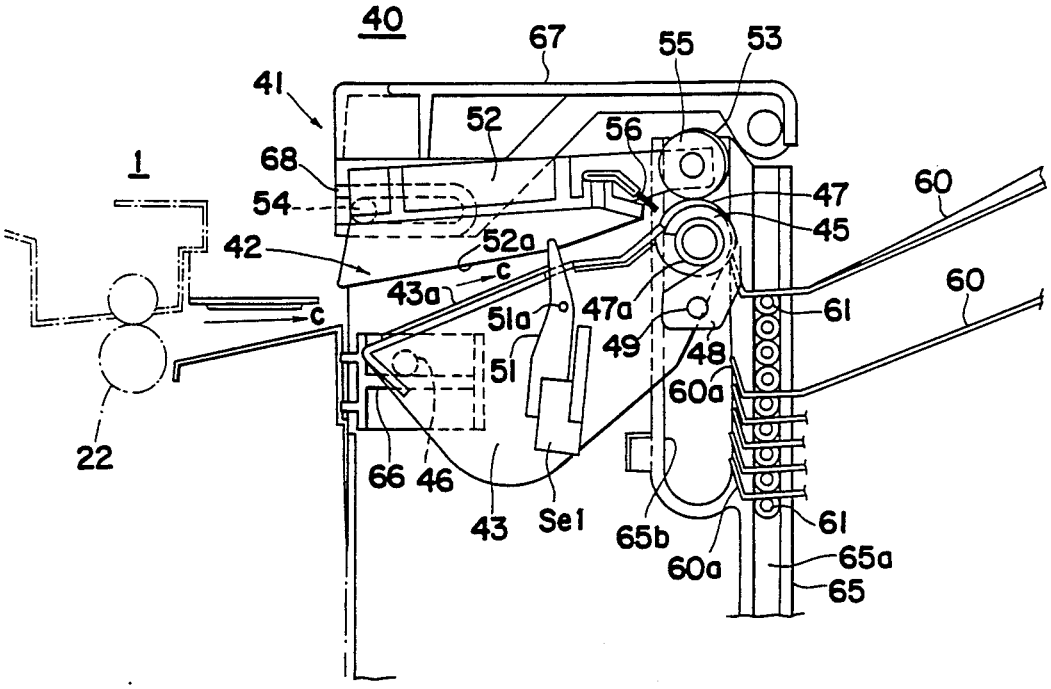
FIG. 3 is a vertical cross-sectional view of a sorting unit.
Figure 8:
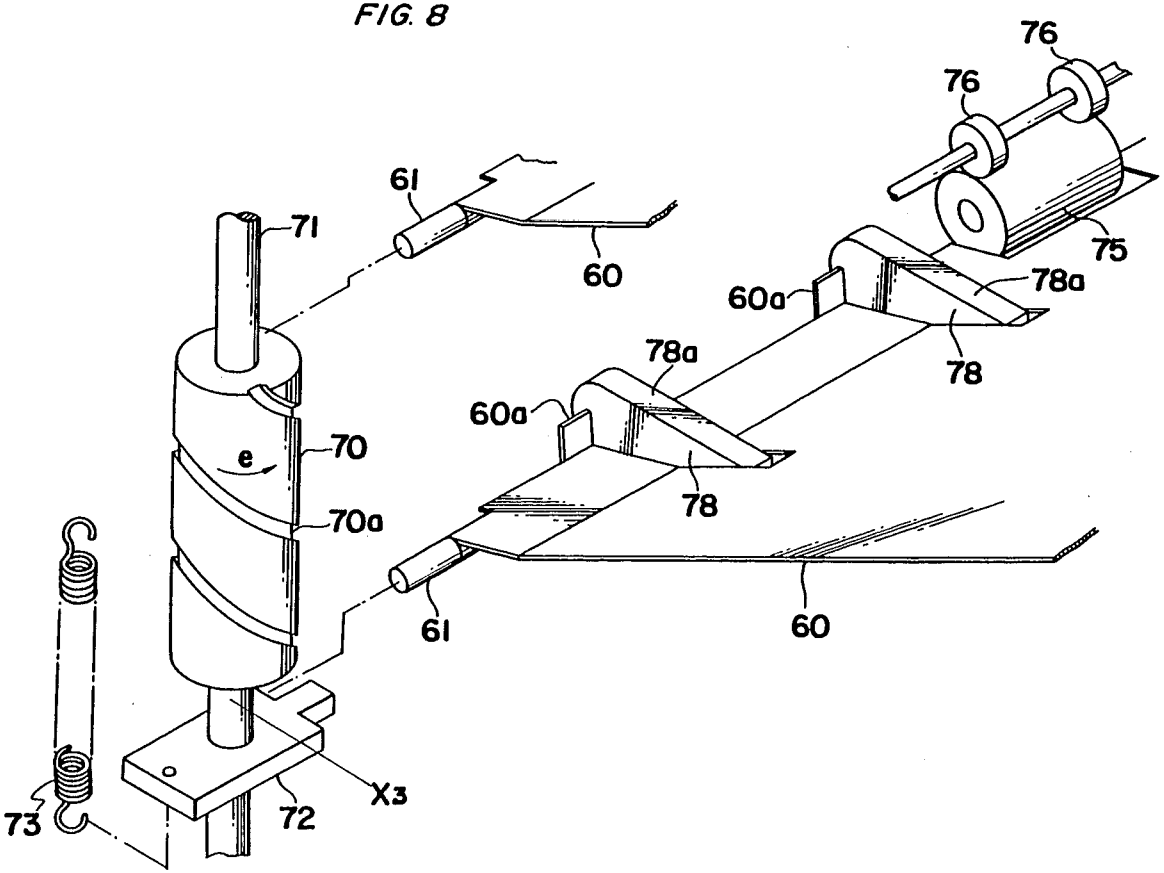
FIG. 8 is a perspective view of the sheet takeout position.
Figure 9:
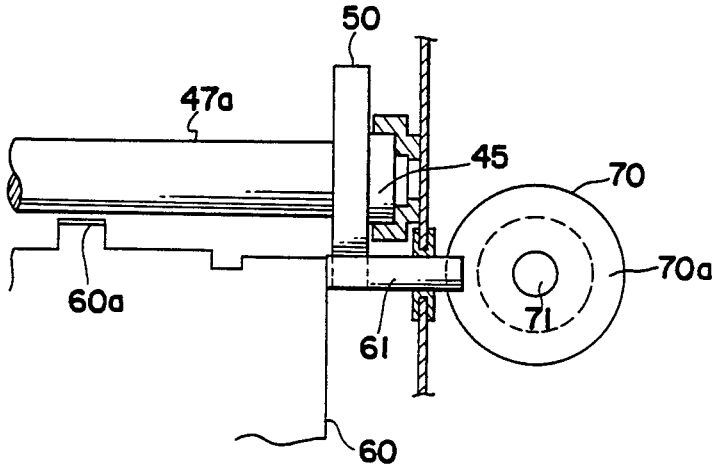
FIG. 9 is a plan view showing a mechanical relationship of the trunnion and the fixed cam.

As shown in FIGS. 2, 3 and 8, a plurality of clicks 60*a* for preventing the reverse flow of the sheets and a pair of trunnions 61 are provided on one end of each bin 60. The trunnions 61 engage with a groove 65*a* extending longitudinally along a pair of guide units 65 (only one is shown in FIG. 3) installed on the frame of the sorter 40 in order to regulate the movements of the bins 60 along the longitudinal direction. Another end of each bin 60 is supported by the bin holder 62. A floating cam 50, which will be explained later, shifts the position of the trunnion 61 so that the intervals of the bins 60 can be increased.

The sorting unit 41 distributes the sheets ejected from the copying machine 1 through relative upward and downward movement between a sheet transport unit 42 disposed opposite to the ejection roller couple 22 of the copying machine 1 and bins 60. As shown in FIG. 3, the sheet transport unit 42 comprises an upper unit 52 having a guiding surface 52*a*, a lower unit 43 having a guiding surface 43*a*, a feed roller 47 and a pinch roller 55 so that the sheet from the rollers 47 and 55 is transported to each bin 60 passing between the guiding surfaces 52*a* and 43*a*.

Figure 4:
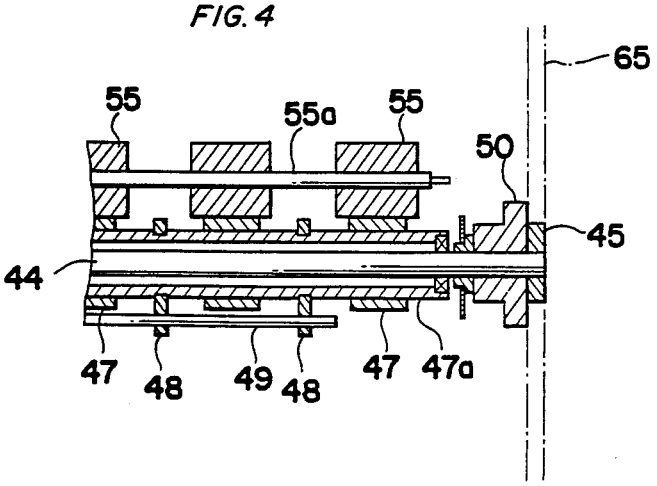
FIG. 4 is a horizontal cross-sectional view of a feed roller section of the sorting unit.
Figure 5:
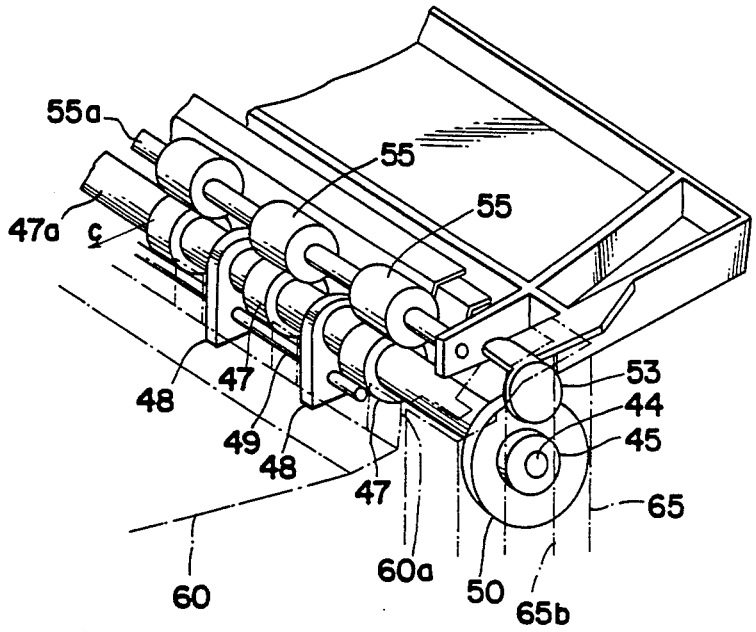
FIG. 5 is a perspective view of a conveyance unit.

One end of the lower unit 43 is supported movably in upward and downward directions by a supporting shaft 44 disposed on the end of bin 60 orthogonally to the sheet transporting direction indicated by an arrow c. Both ends of the shaft 44 engages with the rail unit 65b installed on the guide unit 65 through the collar 45 as shown in FIGS. 4 and 5. Another end of the lower unit 43 has a pin 64 which is supported slidably on a guide member 66.

Figure 6:
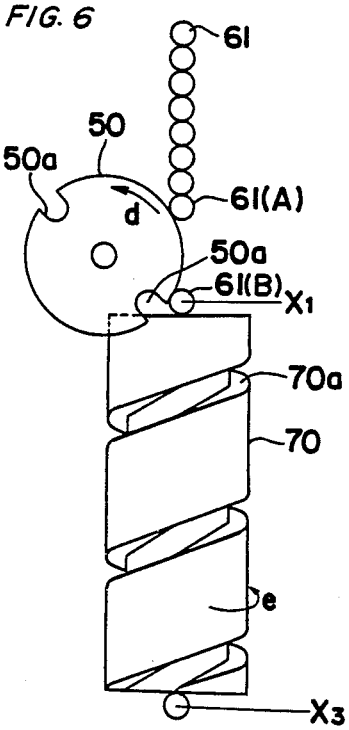
FIG. 6 is an explanatory drawings of floating cam and fixed cam.
Figure 7:
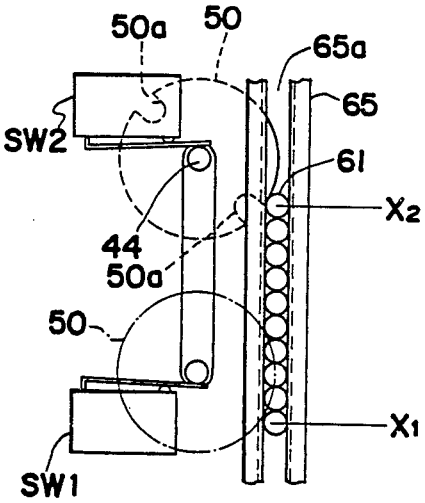
FIG. 7 is an explanatory drawing of the floating cam.

A roller shaft 47a whereto plural number of feed rollers 47 are fixed is installed on said supporting shaft 44 in a manner to permit the free rotation of said roller shaft 47a, and oscillating plates 48 are hung from said roller shaft 47a. The oscillating plates 48 are connected to each other by a rod 49, and the lower part of oscillating plates are located between the reverse flow prevention clicks 60a of said bins 60. Besides, as shown in FIGS. 6 and 7, floating cams 50 with notches 50a and 50a formed on the circumferential surface at intervals of 180° are fixed to both ends of the supporting shaft 44. These floating cams 50 are turned 180° intermittently by the driving source separate from that of the feed roller 47 and support not only the lower unit 43 but also the rear end of bins 60 by means of the trunnions 61 which come to contact their circumferential surface. Furthermore, as shown in FIG. 7, the floating cam 50 can move up and down between a bottom bin position X1 and a top bin position X2, and the cam 50 can be detected by detection switches SW1 and SW2 when it has reached these positions X1 and X2. As shown in FIG. 3, the lower unit 43 is provided with an actuator 51 which turns freely round a pin 51a and a photosensor Se1 which can be turned ON and OFF when said actuator 51 turns keeping in contact with the sheet to be transported.

One end of the upper unit 52 has an engaging piece 53 which engages slidably with the rail unit 65b thereby oscillating up and down. The other end of the upper unit 52 has a pin 54 which engages slidably with a guide member 68 provided to the top cover 67 of the sorter 40 thereby sliding in horizontal direction. A pinch roller 55 is installed pivotally to said upper unit 52 through the supporting shaft 55a. Also, a charge-removing brush 56 is installed to said upper unit 52. The pinch roller 55 pressed against the feed rollers 47 utilizing its own weight, which is capable of being driven by said feed rollers 47.

A transmission type photosensor Se5 (Refer to FIG. 2) whose optical axis is located at the rear end of each bin 60 is installed in said sorting unit 41 so that the presence or absence of the sheets distributed among and in the bins 60 can be detected.

In the above-described composition, the floating cam 50 introduces the trunnion 61 kept in contact with the circumference into the notch 50a by every 180° turn in the direction reverse to the direction of the arrow d, thereby not only causing itself to move upward but also causing the introduced trunnion 61 to shift downward to contact the next trunnion 61. Repeating this action causes each bin 60 to shift downward by one step, while the transport unit 42 moves upward. When the sorting mode is selected, the floating cam 50 is located at the bottom bin position X1 as is shown in FIG. 7, and this cam 50 increases the intervals of the bins 60 as it moves upward step by step from this position. The sheets ejected from the copying machine 1 pass between the guiding surfaces 52a and 43a and between the feed roller 47 and the pinch roller 55 into the bins 60 whose intervals are widened by the floating cam 50. Turning the floating cam 50 towards the normal direction or the direction of the arrow d causes the bins 60 to shift upward one by one, and the cam 50 moves downward together with the transport unit 42.

In the sorting unit 41 having the above-described composition, the sheets can be stored in three different modes. The first mode is the sorting mode to enable the copies of each document to be distributed among the bins 60 and sorted in the order of page numbers. The second mode is the grouping mode to enable the copies of each document to be distributed among the bins 60. The third mode is the non-sorting mode to enable the copies to be stored only in one bin 60.

Construction and Operation of Fixed Cam

Here, the explanation will be made as to the fixed cam 70 and the transport unit 80 which are used for transporting the sheets distributed among the bins 60 to a staple tray 91 which will also be explained in the following.

As shown in FIGS. 6 and 8, the fixed cam 70 has a spiral groove 70a formed turning 3 times round the circumferential area of the fixed cam 70 for enabling the engagement of said trunnion 61 and said groove 70a, and the fixed cam 70 can be turned both towards the normal direction and reverse direction by a motor not shown in the drawing. That is, the fixed cam 70 turns towards the normal direction or the direction of the arrow e to lower the trunnion 61 of the bins 60, which has been shifted to the bottom bin position X1 by said floating cam 50, to the sheet takeout position X3.

On the other hand, as shown in FIG. 8, at the sheet takeout position X3, a receiving member 72 installed to a supporting shaft 71 is not only movable up and down freely along said supporting shaft 71 but also is urged upward by a coil spring 73, thus the trunnion 61 descended to the takeout position X3 supporting flexibly. Said takeout position X3 is provided with a takeout roller 75, pinch rollers 76 which are pressed against said roller 75 by their own weight and sheet guides 78. Also, as shown in FIG. 2, a sheet reverse flow prevention guide 79 is installed between the bottom bin position X1 and the takeout position X3. As shown in FIG. 8, each sheet guide 78 is installed so that a guiding surface 78a on the top of said sheet guide 78 comes a little above the position of the sheet reverse flow prevention click 60a of each bin 60 which has descended to the takeout position X3 by increasing the angle of its inclination. As shown in FIG. 2, the pinch rollers 76 are rotatably supported with a supporting shaft 77a through an arm 77 and are kept in contact with or retracted form the roller 78 by a solenoid not shown in the drawing.

Figure 10:
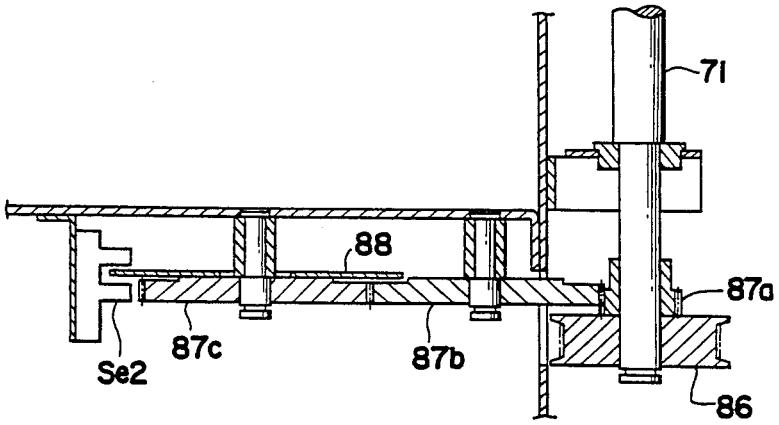
FIG. 10 is a vertical cross-sectional view showing a rotary detector of the fixed cam.

Furthermore, as shown in FIG. 10, a driving pulley 86 and a gear 87a are integrally fixed to the lower end of the supporting shaft 71 of said fixed cam 70. The gear 87a engages with a gear 87b which in turn engages with a gear 87c. A disk 88 integrally fixed to the gear 87c has the notches not shown in the drawings which are detected by a photosensor Se2 in order to control the number of revolutions of the fixed cam 70.

As shown in FIG. 2, the transport unit 80 comprises transport rollers 81a, 81b–83a and 83b and guide plates 84a, 84b, 85a and 85b. The transport rollers 81a, 82a and 83a are made of rubber material, while the transport rollers 81b, 82b and 83b are made of spongy material so that they are able to transport the various thickness of stacked sheets.

In the above-described arrangement, the fixed cam 70 is turned 3 times towards the direction of arrow e after said sorting unit 41 has completed the distribution of the sheets. The trunnion 61 of each bin 60 at the bottom bin position X1 is guided by the spiral groove 70a to come down to the takeout position X3 where the trunnion 61 is supported with the receiving member 72. At this takeout position X3, the bin 60 inclines at a larger angle than it does at the bottom bin position X1 so that the sheets distributed and stored slide down on the guiding surface 78a of the guide 78 due to their own weights. The takeout roller 75 overlaps with the bin 60 so that the end of the sheets are inserted between the rollers 75 and 76 when the bin 70 has reached the takeout position X3, and the sheets are transported to the transport rollers 81*a* and 81*b* by the rollers 75 and 76. Even when the sheets are curled downward, the sheets can be transported between the guide plates 84*a* and 84*b* without fail guided by the guide 78 and the takeout roller 75. Also, even when the sheets are curled upward, the sheets are transported between the guide plates 84*a* and 84*b* guided by the reverse flow prevention guide 79.

When the sheets are transported by the rollers 81*a* and 81*b*, the solenoid not shown in the drawings is turned off (off is initial state) so that the pinch roller 76 moves upward away from the top of the takeout roller 75. On the other hand, when the bin 60 has reached the takeout position X3, the solenoid is turned on to nip the sheets between the pinch rollers 76 and the takeout rollers 75 and the takeout rollers 75 and the transport rollers 81*a*, 81*b*, 82*a*, 82*b*, 83*a* and 83*b* are driven to turn respectively, and this causes the sheets to be transported onto the staple tray 91 through the transport rollers 83*a* and 83*b* as indicated by an arrow f in FIG. 2.

On the other hand, at the time of sheet takeout operation, the floating cam 50 comes to the position corresponding to the bottom bin position X1 and supports the trunnion 61 immediately before being fed to the fixed cam 70 so that the trunnions 61 can be fed to the fixed cam 70 one by one as said floating cam 50 turns 180° intermittently towards the direction reverse to that of an arrow d. In this embodiment, in order to increase the angle of inclination of the bin 60 at the takeout position X3 to facilitate the sheets on the bin 60 sliding downward by their own weight, the interval between the bottom bin position X1 and the takeout position X3, that is, the stroke of the bin 60 that is to move between these two points can be made relatively large. Thus, the torque needed for rotating the fixed cam 70 can be reduced by a small pitch of spiral groove 70*a*. The trunnion 61 is moved from the position X1 to the position X3 by triple rotations of the fixed cam 70 with reduced torque. The trunnion 61(A) immediately before the trunnion 61(B) is supported by the floating cam 50 is fed to the fixed cam 70 so that the trunnion 61(A) can be prevented from being fed to the spiral groove 70*a* at the time of the second or the third turn of the fixed cam 70.

As explained in the foregoing, as the floating cam 50 turns reversely by 180°, and the fixed cam 70 turns 3 times respectively, the bins 60 are brought down step by step to the takeout position X3, and the sheets distributed among the bins 60 are transported onto the staple tray 91 by the transport unit 80.

Each bin 60 brought down to the takeout position X3 is supported by the receiving member 72. And the bin 60 returns to its upward original position by the rotation of the fixed cam 70 towards the direction reverse to the arrow e, and the floating cam 50 towards its normal direction or the direction of the arrow d after all the sheets distributed among the bins 60 are taken out.

Construction and Operation of Stapling Unit

As shown in FIG. 2, the stapling unit 90 comprises the staple tray 91, a motor to vibrate the staple tray 91, a guide plate 95, a stopper 96 and a stapler 100. The staple tray 91 is oscillatably installed on the supporting shaft 92 to serve as a supporting point, and the staple tray 91 vibrates by the centrifugal force of an eccentric weight 94 turns by the motor 93. This vibration causes the sheets which have been transported from said transport unit 80 to be trued up while they are regulated by the stopper 96.

Figure 11:
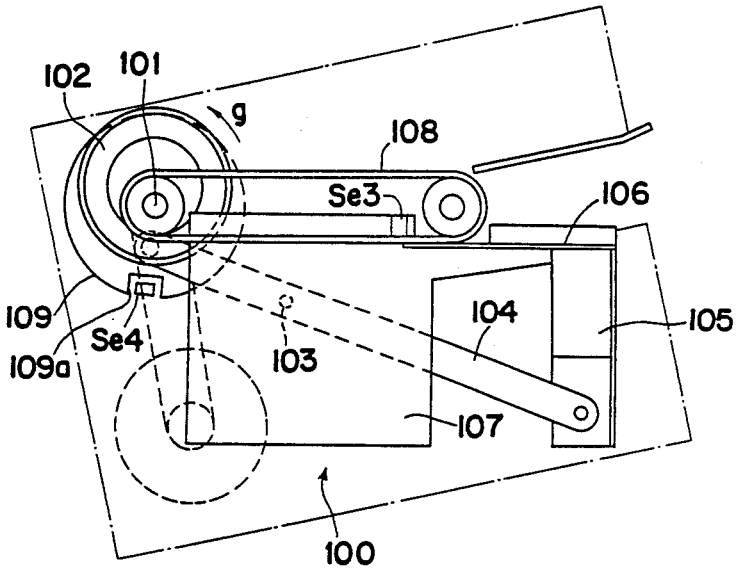
FIG. 11 is a plan view of a stapler.

As shown in FIG. 11, the stapler 100 comprises a fixed output shaft 101 of a motor, an oscillating arm 104 on a pin 103 to serve as a supporting point and a cam 102 whose circumferential part is connected to a head 105 so that the rotation of the cam 102 towards the direction of an arrow g by the motor causes the head 105 to move upward through the arm 104, and a staple 106 binds the sheets trued up on the tray 91. The staples 106 are contained in a cartridge 107 and transported to the head 105 by the conveyor belt 108 which is driven to turn by said output shaft 101 of the motor.

The stopper 96 is installed on the supporting shaft 97 to serve as a supporting point so that the stopper 96 can be turned by a solenoid not shown in the drawings. The stopper 96 is normally located on the lower end of the staple tray 91 to determine the end position of the sheets. When the solenoid is turned on, the stopper 96 retreats downwards to cancel the sheet positioning.

The stapler 100 is provided with a photosensor Se3 for detecting the absence of the staples 106 and a sensor Se4 for detecting the number of revolutions of the staple motor so that the sensor Se3 directly detects the staples 106, while the sensor Se4 detects the notch 109*a* of a disk 109 fixed to the output shaft 101 of the motor.

Furthermore, the stapling unit 90 is provided with a photosensor Se6 for detecting the presence and absence of the sheet on the staple tray 91 and a switch SW4 for detecting the mounting and dismounting of the stapler 100.

In the above-described arrangement, the sheets transported onto the staple tray 91 from said transport unit 80 are trued up by the guide plate 95 and the stopper 96 as the tray 91 is vibrated by the rotation of the motor 93. The trued up sheets are bound by the staple motor. When the solenoid is turned on to withdraw the stopper 96 from the tray 91, the bound sheets slides down onto the stack tray 111 by being guided by the plate 98. Such stapling operation is repeated each time when the sheets in the bins 60 are carried onto the staple tray 91.

The absence of the staples 106 is not necessarily required to be detected only by the sensor Se3. That is, at the time of the stapling operation, the absence of the staples 106 can also be detected by said sensor Se4, since the number of revolutions of the staple motor increases when the torque needed for rotating the cam 102 has decreased due to the absence of the staples 106. Thus, the increase in the number of revolutions of the staple motor indicates the absence of the staples 106.

Construction of Stack Unit

Figure 12:
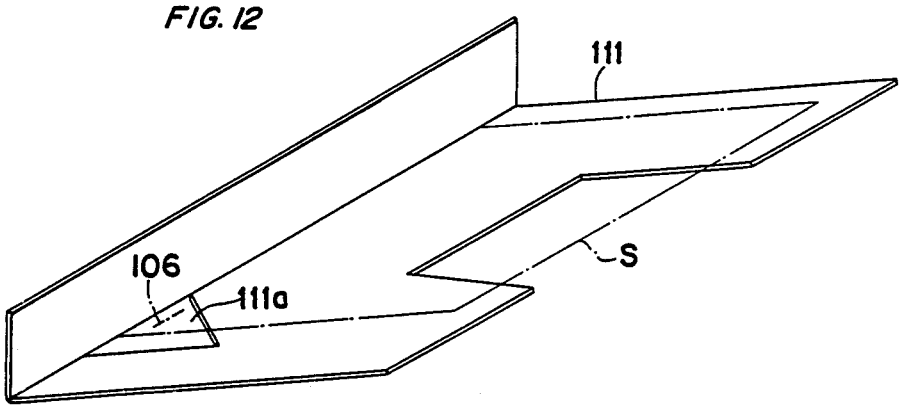
FIG. 12 is a perspective view of a stack tray.

The stack unit 110 comprises the stack tray 111 which is designed for finally containing the sheets bound by said stapler 100. As shown in FIG. 12, the stack tray 111 has a notch 111a in its part to be used for the stapling of the sheet S, that is, the part where the part of the sheet stapled with the staple 106 is located so that the sheet bound with the stapler 100 and placed on the tray 111 hangs down into the notch 111a by its own weight, whereby not only the stapled parts of bound sheets can be prevented from becoming higher than the non-stapled parts when they are stacked but also the stacking capacity of the tray 111 can be increased.

Figure 13:
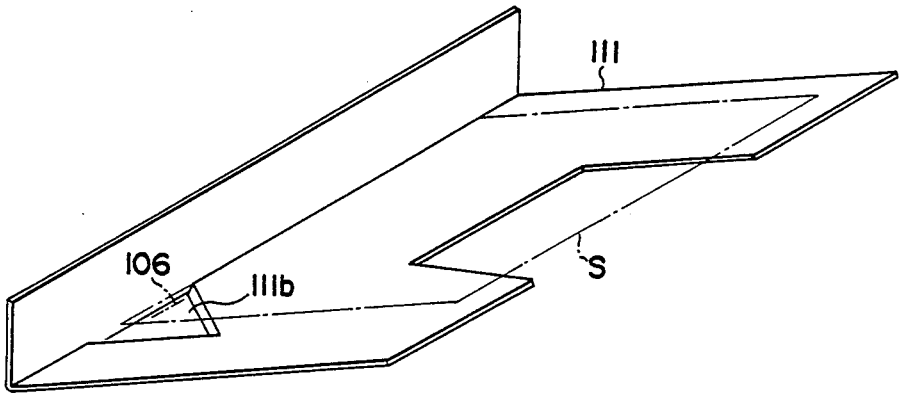
FIG. 13 is a perspective view showing another example of the stack tray.

The similar effect can also be achieved when an indent 111b is formed in the part of the stack tray 111 where the parts of the sheets bound with staples 106 are stacked as shown in FIG. 13.

Operation Panel

Figure 14:
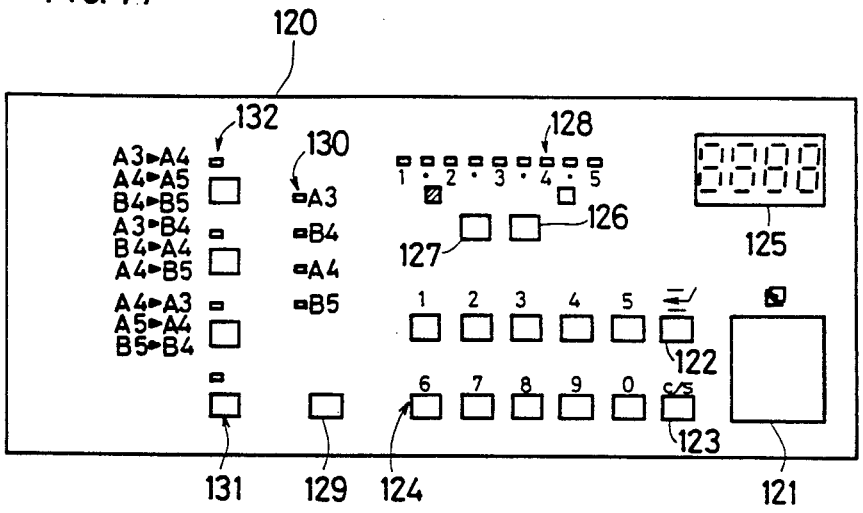
FIG. 14 is a plan view showing an operation panel of the copying machine.
Figure 15:
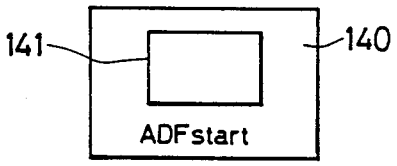
FIG. 15 is a plan view showing an operation panel of the ADF.
Figure 16:
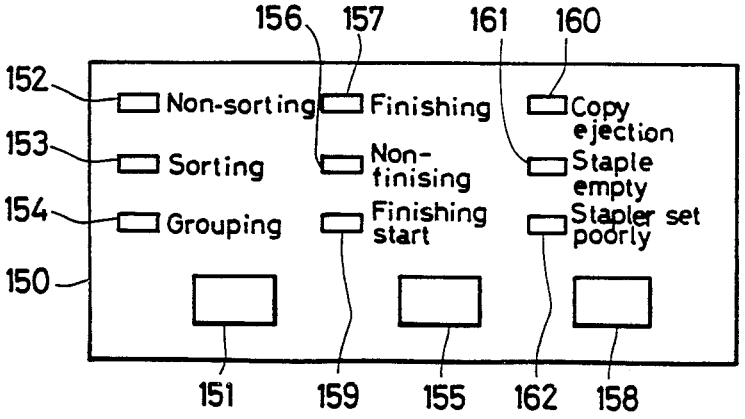
FIG. 16 is a plan view showing an operation panel of the sorter.

In this embodiment, operation panels are installed at the three places in a copying machine panel 120, an ADF panel 140 and a sorter panel 150 as shown in FIGS. 14, 15 and 16 respectively.

Installed on the copying machine panel 120 are a print key 121 for starting the copying operation when ADF 30 is not used, an interruption key 122 for interrupting the multicopying operation temporarily, a clear/stop key 123 for stopping the copying operation or cancelling the set numbers, ten key group 124 for setting the numbers of multicopies, an indicator 125 for indicating the number of copies and the condition of the copying machine 1, up/down keys 126 and 127 for setting the density for copies, LEDs 128 for indicating the density for copies, a sheet selection key 129 for selecting the sheet size, LEDs 130 for indicating said sizes, magnification selection key group 131 for selecting the copying magnification and LED group 132 for indicating said magnifications.

Installed on the ADF panel 140 is only a start key 141 for starting the ADF 30. When this start key 141 is turned on, the documents on the document tray 31 are automatically transferred one by one onto the glass 29 of the document rest, and the copying operation is started.

Installed on the sorter panel 150 are a sorter mode selection key 151, non-sorting mode indication LED 152, sorting mode indication LED 153 and grouping mode indication LED 154 wich are the indicators of said sorter mode selection key 151, finishing mode selection key 155, non-finishing mode indication LED 156 and finishing mode indication LED 157 which are the indicators of said finishing mode selection key 155, finishing start key 158 and LED 159 as the indicator for said finishing start key 158. The LED 159, when lighted, indicates that the finishing operation is in progress, and, when is flicking, alarms for the necessity of removing the sheets from the staple tray 91. A LED 160 alarms for requiring the necessity of removing the sheets from bins 60, a LED 161 alarms for indicating that the staple 106 is absent and a LED 162 alarms for indicating the poor setting of stapler 100.

The sorter mode selection key 151 selects the modes in the order of non-sorting mode, sorting mode and grouping mode when the key 151 is depressed in succession, and the corresponding LEDs 152, 153 and 154 are lighted accordingly. The finishing mode selection key 155 also selects the modes in the order of non-finishing mode and finishing mode when the key 155 is depressed in succession, and the corresponding LEDs 156 and 157 are lighted accordingly. The finishing start key 158 outputs the signals in the order of the signal for the start of finishing operation and the signal for its cancellation when the key 158 is depressed in succession, and LED 159 lights when the key 158 is depressed for the start of finishing operation.

Control Circuit

Figure 17:
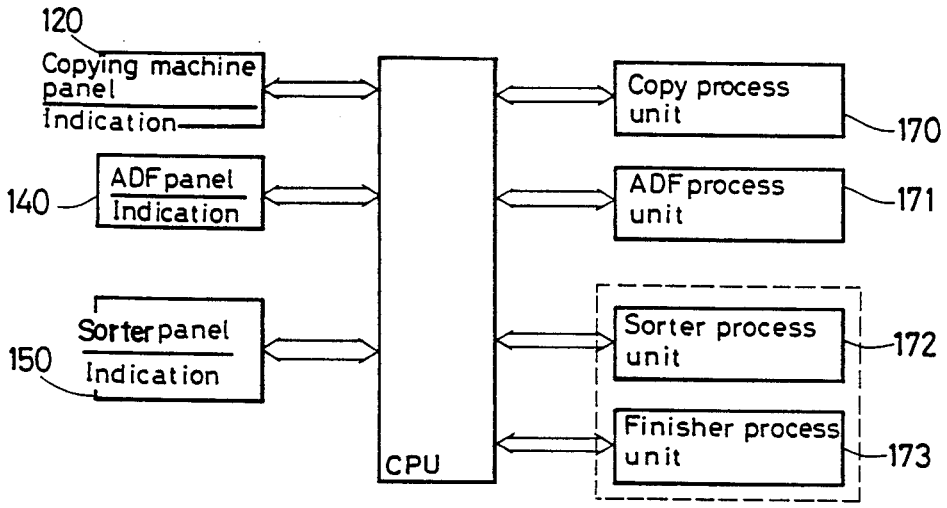
FIG. 17 is a block diagram showing a control circuit.

FIG. 17 is a block diagram of the control circuit wherein a microcomputer is connected to the copying machine panel 120, ADF panel 140, sorter panel 150, copy processing unit 171, ADF processing unit 171, sorter processing unit 172 and finisher processing unit 173 so that the signals can be exchanged with each other.

Figure 18:
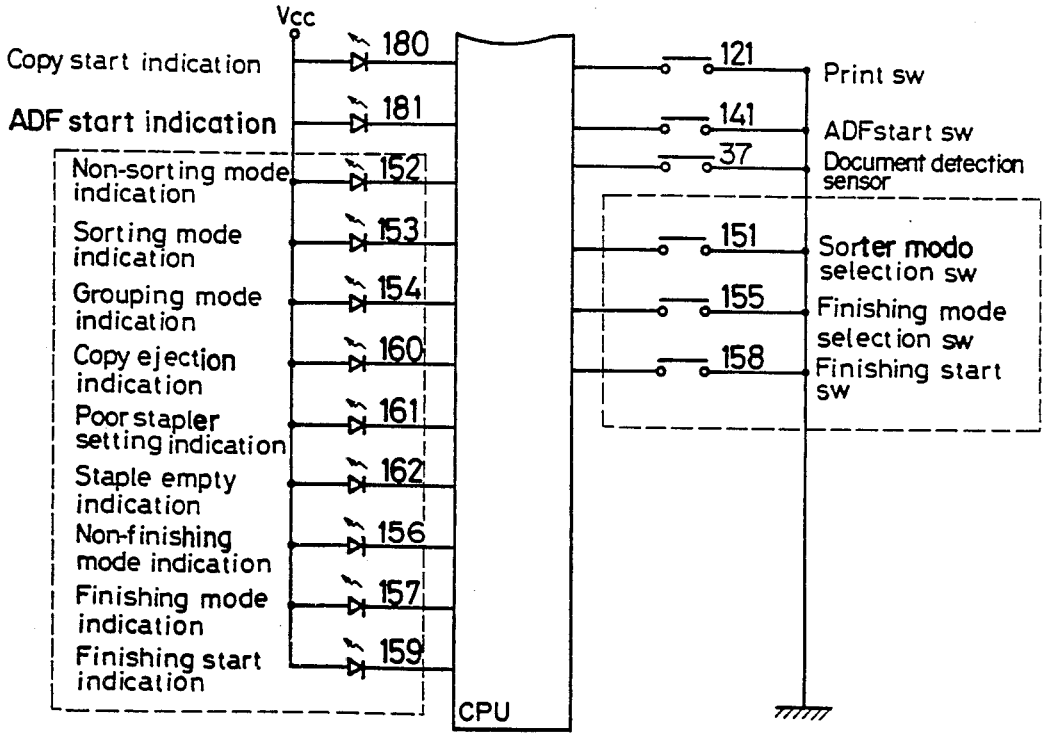
FIG. 18 is details of the control circuit.

FIG. 18 shows the essential part of the control circuit wherein the input/output port of the microcomputer is connected to the print switch, ADF switch and their built-in indicator LEDs 180 and 181, various selection switches of the sorter panel 150, various indicator LEDs.

Control Procedure

Here, the control procedures of the copying machine 1 and the sorter 40 based on the control circuit will be explained in reference to FIG. 19 and on.

Figure 19:
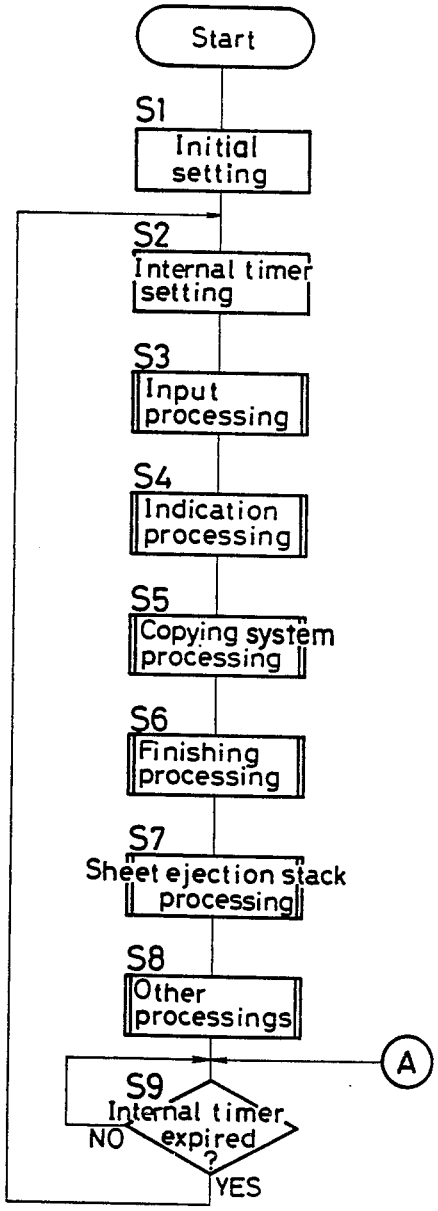
FIG. 19 is a flow chart showing a main routine of the CPU.

FIG. 19 shows a main routine of said microcomputer.

When the microcomputer is reset, and the program is started, the clearance of random access memory at step S1 and initialization (or setting for initial mode) of various registers and units take place. An internal timer starts at step S2. The internal timer is for setting the time required for the execution of the main routine, which is to be set in advance at the time of initialization at step S1.

Various subroutines, which will be explained later, are called one by one at steps S3 through S8. When the execution of all the subroutines are completed, the procesing returns to step S2 after the time set by said internal timer has passed at step S9. The length of time required for one routine is used in making various counting with various counters during the execution of the subroutines.

Figure 20A:
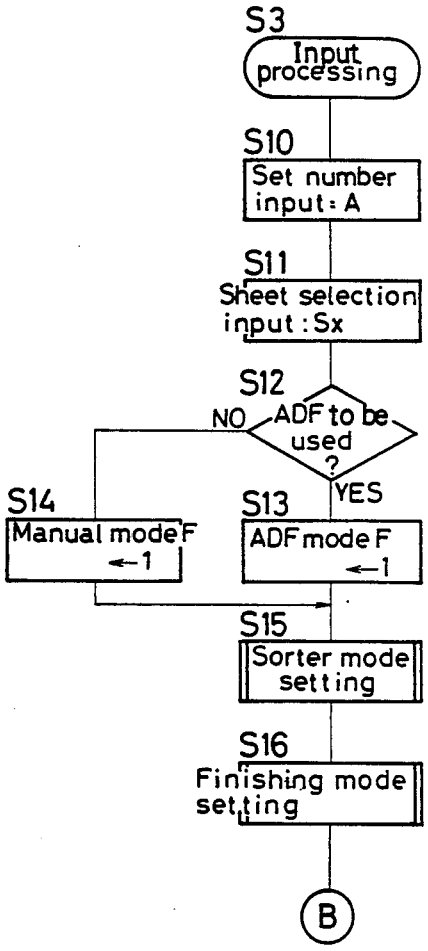
FIGS. 20*a* and 20*b* are flow charts showing a subroutine for the input processing.
Figure 20B:
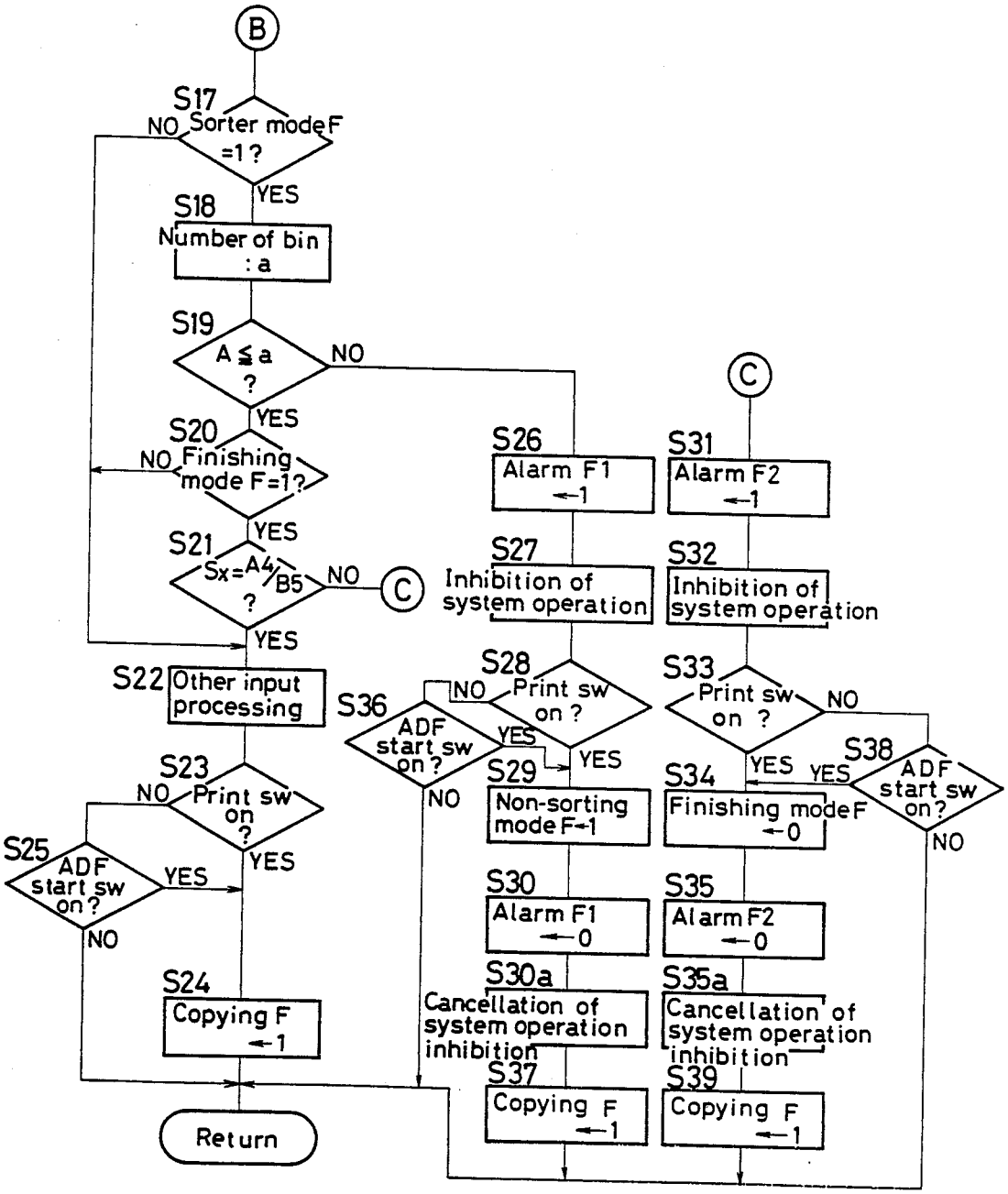

FIGS. 20*a* and 20*b* show a subroutine for the input processing to be executed at step S3 of the main routine.

First, a set number A is inputted through the ten key group 124 on the copying machine panel 120 at step S10. Then, the sheet size Sx selected at step S11 is inputted, and whether the ADF 30 has been selected for use at step S12 is checked. When said ADF 30 has been selected for use, an ADF mode flag is set to "1" at step S13, and, when not selected, a manual mode flag is set to "1".

A subroutine for setting sorter mode is executed at step S15. A subroutine for setting finishing mode is executed at step S16, and whether the sorter mode flag is "1" or not at checked at step S17. When the sorter mode flag is "0", the sorting and stapling operations will not be executed, so that the processing goes to step S22. When the sorter mode flag is "1", bin number a is inputted at step S18, and said set number A and the bin number a are compared at step S19. When the set number A is less than the bin number a, the operation in the sorting mode is possible. Whether the finishing mode flag is "1" or not is checked at step S20. When the finishing mode flag is "0", the processing goes to step S22, and, when is "1", whether the sheet size Sx is A4 size or B5 size is checked at step S21. In this embodiment, the sheet sizes allowed for stapling operation are A4 size and B5 size. When the result is "Yes", other input processings are executed at step S22.

Further, whether the print switch 121 is turned on or not is checked at step S23. When turned on, the copying flag is set to "1" at step S24 for enabling the copying operation. When not on, whether the ADF start switch 141 is turned on or not is checked at step S25. When turned on, the processing at said step S24 is executed, and, when not on, the subroutine will be terminated.

On the other hand, set number A is found to be larger than the bin number a at said step S19, alarm flag F1 is set to "1" at step S26, and the operation of the system is inhibited at step S27. Said alarm flag F1 is for the indication at the time when the number for distribution has exceeded the number of the bins 60. At steps S28 and S36, whether the print switch 121 and the ADF start switch 141 are turned on respectively are checked in the same manner as that at steps S23 and S25. When the result is "Yes" or the operator's will for executing the copying operation regardless of alarm signal, a non-sorting mode flag is set to "1" at step S29, and the alarm flag F1 is reset to "0" at step S30. Then, the inhibition of system operation is cancelled at step S30*a*, and the copying flag is set to "1" at step S37.

Further, when the sheet size Sx is judged to be other than A4 size and B5 size at said step S21, stapling operation is not possible, so that an alarm flag F2 is set to "1" at step S31, and the operation of the system at step S32 is inhibited. Said alarm flag F2 is for indicating that the selected sheet size is wrong. Then, whether the print switch 121 and the ADF start switch 141 are turned on respectively are checked at steps S33 and S38 in the same manner as that at steps S23 and S25. When the operator's will for executing the copying operation regardless of the alarm signal at step S33 or step S38 is confirmed, the finishing mode flag is reset to "0" at step S34, and the alarm flag F2 is reset to "0" at step S35. The inhibition of the system operation is cancelled at step S35*a*, and the copying flag is set to "1" at step S39.

Figure 21:
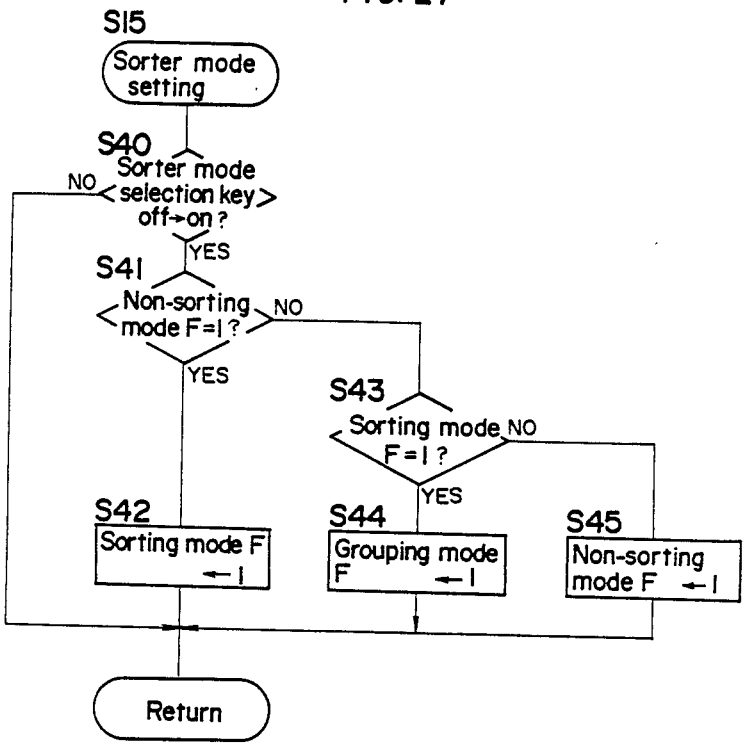
FIG. 21 is a flow chart showing a subroutine for the sorter mode setting.

FIG. 21 shows a subroutine for the sorter mode setting to be executed at said step S15.

In the subroutine, whether or not the sorter mode selection key 151 is changed to on from off is checked at step S40. When the result is "No", the subroutine is terminated at once. When the result is "Yes", at steps S41 and S43, whether or not a non-sorting mode flag and a sorting mode flag are set to "1" are checked respectively. When the non-sorting mode flag has been set to "1", the sorting mode flag is set to "1" at step S42. When the sorting mode flag has been set to "1", a grouping mode flag is set to "1" at step S44. When the non-sorting mode flag and the sorting mode flag have been reset to "0", or at this time the grouping mode flag has been set to "1", the non-sorting mode flag is set to "1" at step S45.

Figure 22:
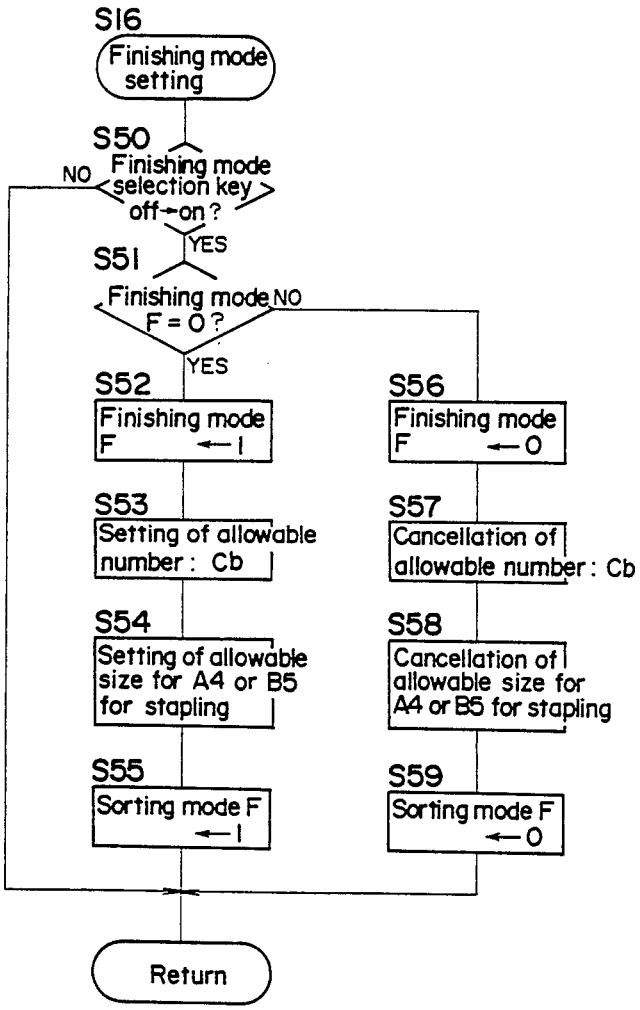
FIG. 22 is a flow chart showing a subroutine for the finishing mode setting.
Figure 23A:
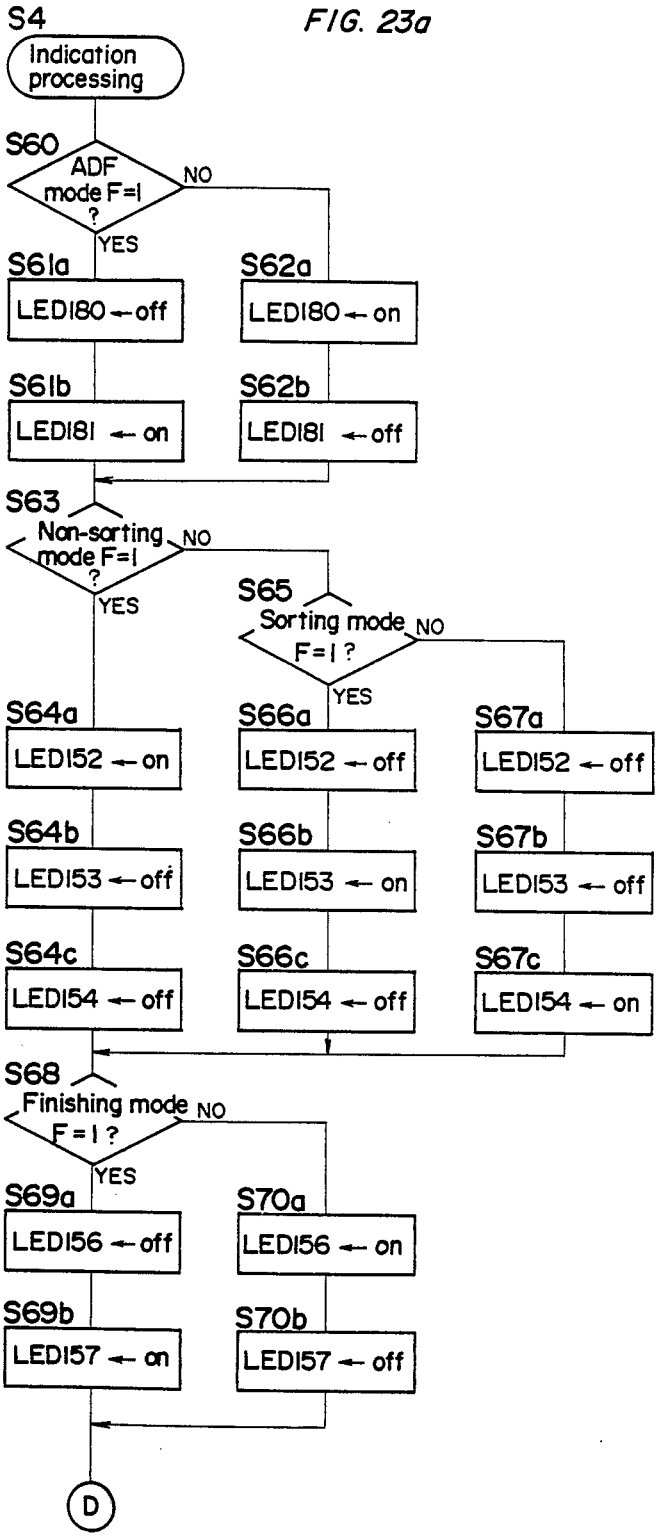
FIGS. 23*a*, 23*b*, 23*c* and 23*d* are flow charts showing a subroutine for the indication processing.
Figure 23B:
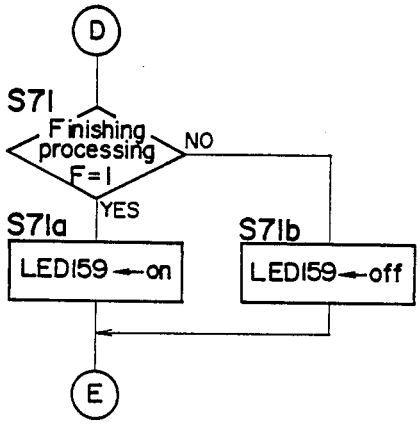
Figure 23C:
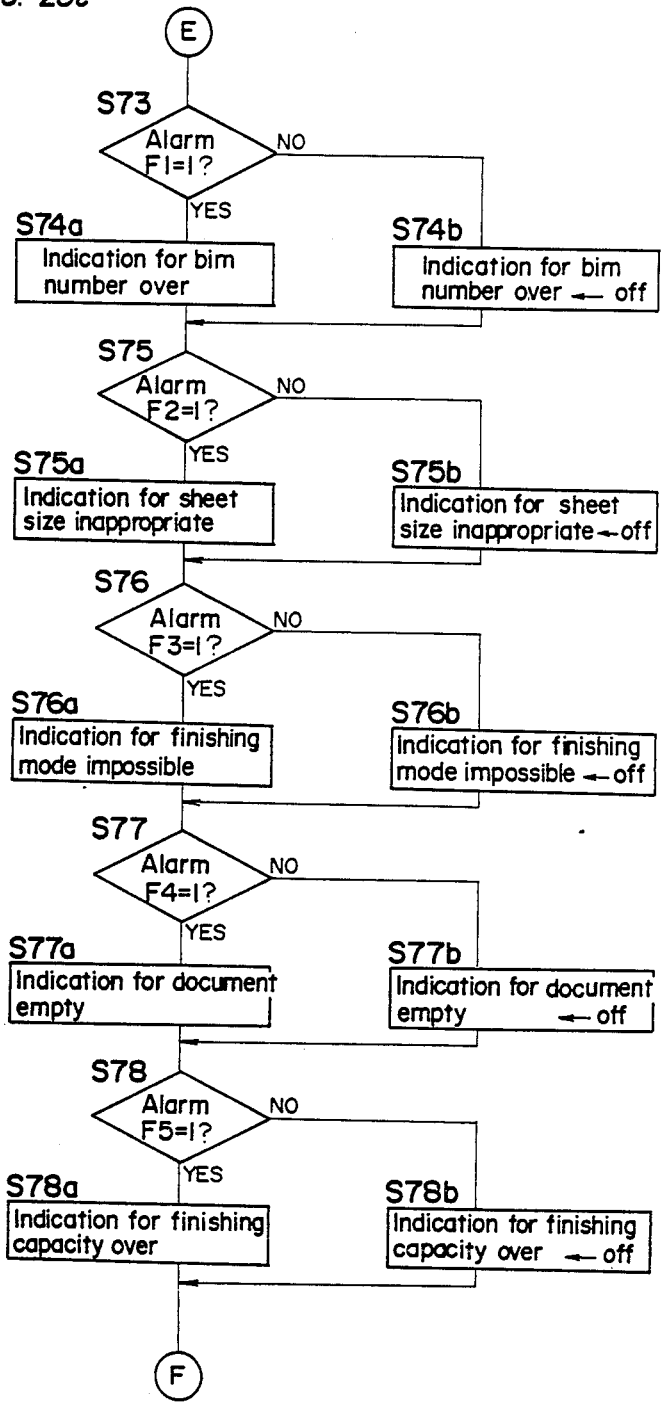
Figure 23D:
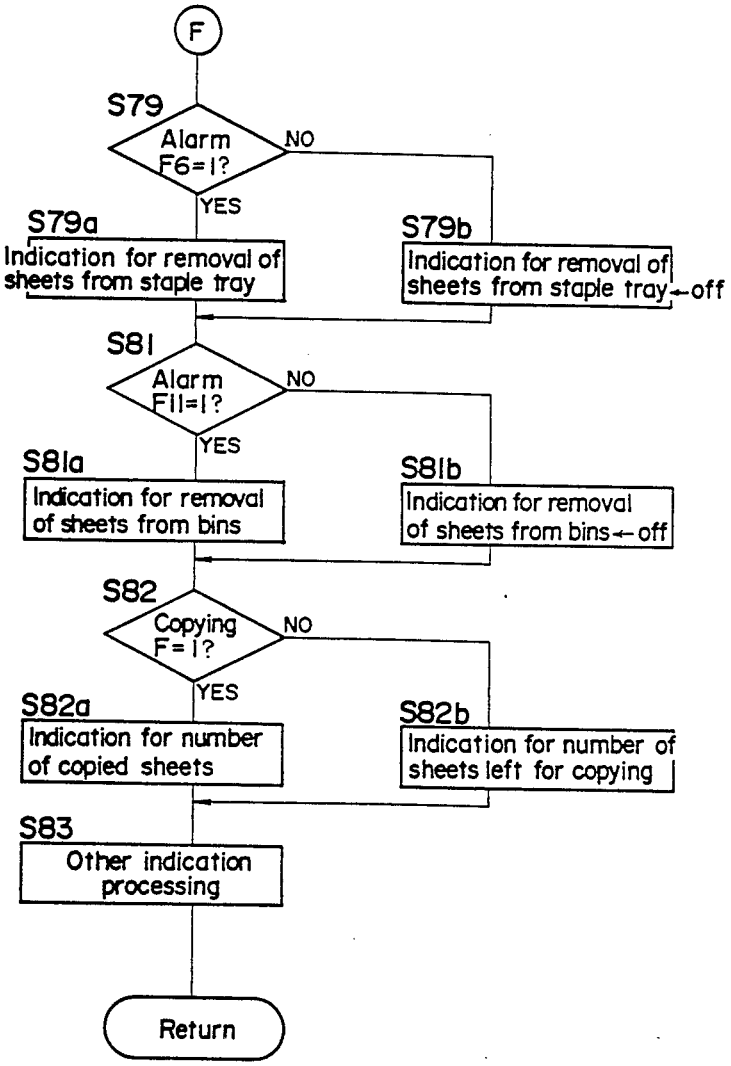

FIG. 22 shows a subroutine for the finishing mode setting to be executed at said step S16.

First, whether or not the finishing mode selection key 155 is changed to on from off is checked at step S50. When the result is "No", the subroutine is terminated at once. When the result is "Yes", at step S51, whether or not the finishing mode flag is reset to "0" is checked. When the flag is reset to "0", so the finishing mode has not be selected, the finishing mode flag is set to "1" at step S52. Then, allowable stapling number Cb is set at step S53. The allowable size for stapling is set to A4 or B5 at step S54. The sorting mode flag is set to "1" at step S55 for allowing the operation in the sorting mode.

On the other hand, at said step S51, when the flag has been set to "1", so the finishing mode has been selected, the finishing mode flag is reset to "0" at step S56. Then, allowable stapling number Cb is cancelled at step S57. The allowable size for stapling is cancelled at step S58. The sorting mode flag is reset to "0" at step S59, the operation in the sorting mode is inhibited.

FIGS. 23*a* through 23*d* show a subroutine for the indication processing to be executed at step S4 of the main routine.

First, whether the ADF mode flag is set to "1" or not is checked at step S60. When is set to "1", the LED 180 for indicating the non-ADF mode is turned off at step S61*a*, the LED 181 for indicating the ADF mode is turned on at step S61*b*. When the ADF mode flag is reset to "0", the LED 180 in turned on at step S62*a*, the LED 181 is turned off at step S62*b*.

Further, whether the non-sorting mode flag and the sorting mode flag are set to "1" or not are checked at steps S63 and S65 respectively. When the non-sorting mode flag has been set to "1", the LED 152 for indicating the non-sorting mode is turned on at step S64*a*, the LEDs 153 and 154 are turned off at steps S64*b* and S64*c*. When the sorting mode flag has been set to "1", the LED 152 is turned off at step S66*a*, the LED 153 for indicating the sorting mode is turned on at step S66*b*, the LED 154 is turned off at step S66*c*. When said two flags have been reset to "0", the LEDs 152 and 153 are turned off at steps S67*a* and S67*b*, the LED 154 for indicating the grouping mode is turned on at step S67*c*.

Next, at step S68, whether the finishing mode flag is set to "1" or not is checked. When is set to "1", the LED 156 for indicating the non-finishing mode is turned off at step S69*a*, the LED 157 for indicating the finishing mode is turned on at step S69*b*. When the finishing mode flag is reset to "0", the LED 156 is turned on at step S70, the LED 157 is turned off at step S70*b*. At step S71, whether the finishing processing flag is set to "1" or not is checked. When is set to "1", the LED 159 for indicating the finishing processing has started is turned on at step S71*a*. When is reset to "0", the LED 159 is turned off at step S71*b*.

Further, at step S73, the alarm flag F1 is checked as to whether is set to "1" or not. When the flag F1 is set to "1", the indicator 125 indicates that the number of bins is over at step S74*a*. When the flag F1 is reset to "0", the indication for bin number over on the indicator 125 is turned off at step S74*b*. At step S75, the alarm flag F2 is checked as to whether is set to "1" or not. When the flag F2 is set to "1", the indicator 125 indicates that the sheet size is inappropriate at step S75*a*. When the flag F2 is reset to "0", the indication for sheet size inappropriate on the indicator 125 is turned off at step S75*b*. At step S76, the alarm flag F3 is checked as to whether is set to "1" or not. When the flag F3 is set to "1", the indicator 125 indicates that the finishing mode is impossible at step S76*a*. When the flag F3 is reset to "0", the indication for finishing mode impossible on the indicator 125 is turned off at step S75*b*. At step S77, the alarm flag F4 is checked as to whether is set to "1" or not. When the flag F4 is set to "1", the indicator 125 indicates tha the document is absent at step S77*a*. When the flag F4 is reset to "0", the indication for document empty on the indicator 125 is turned off at step S77*b*. At step S78, the alarm flag F5 is checked as to whether is set to "1" or not. When the flag F5 is set to "1", the indicator 125 indicates that the finishing capacity is over at step S78*a*. When the flag F5 is reset to "0", the indication for finishing capacity over on the indicator 125 is turned off at step S78*b*. At step S79, the alarm flag F6 is checked as to whether is set to "1" or not. When the flag F6 is set to "1", the LED 159 is flickering at step S79*a*, indicates that the sheets need to be removed from the staple tray 91. When the flag F6 is reset to "0", the LED 159 is turned off, so the indication for removal of sheets from the staple tray 91 is turned off at step S79*b*. At step S81, the alarm flag F11 is checked as to whether is set to "1" or not. When the flag F11 is set to "1", the LED 160 is turned on at step S81*a*, indicates that the sheets need to be removed from the bins 60. When the flag F11 is reset to "0", the LED 160 is turned off, so the indication for removal of the sheets from the bins 60 is turned off at step S81*b*.

Further, whether the copying flag is set to "1" or not is checked at step S82. The indicator 125 indicates the number of copied sheets or the number of sheets left for copying at step S82*a* when the copying flag is set to "1", and at step S82*b* when it is reset to "0". Subsequently, other indication processings are executed at step S83 so that this subroutine can be completed.

Figure 24:
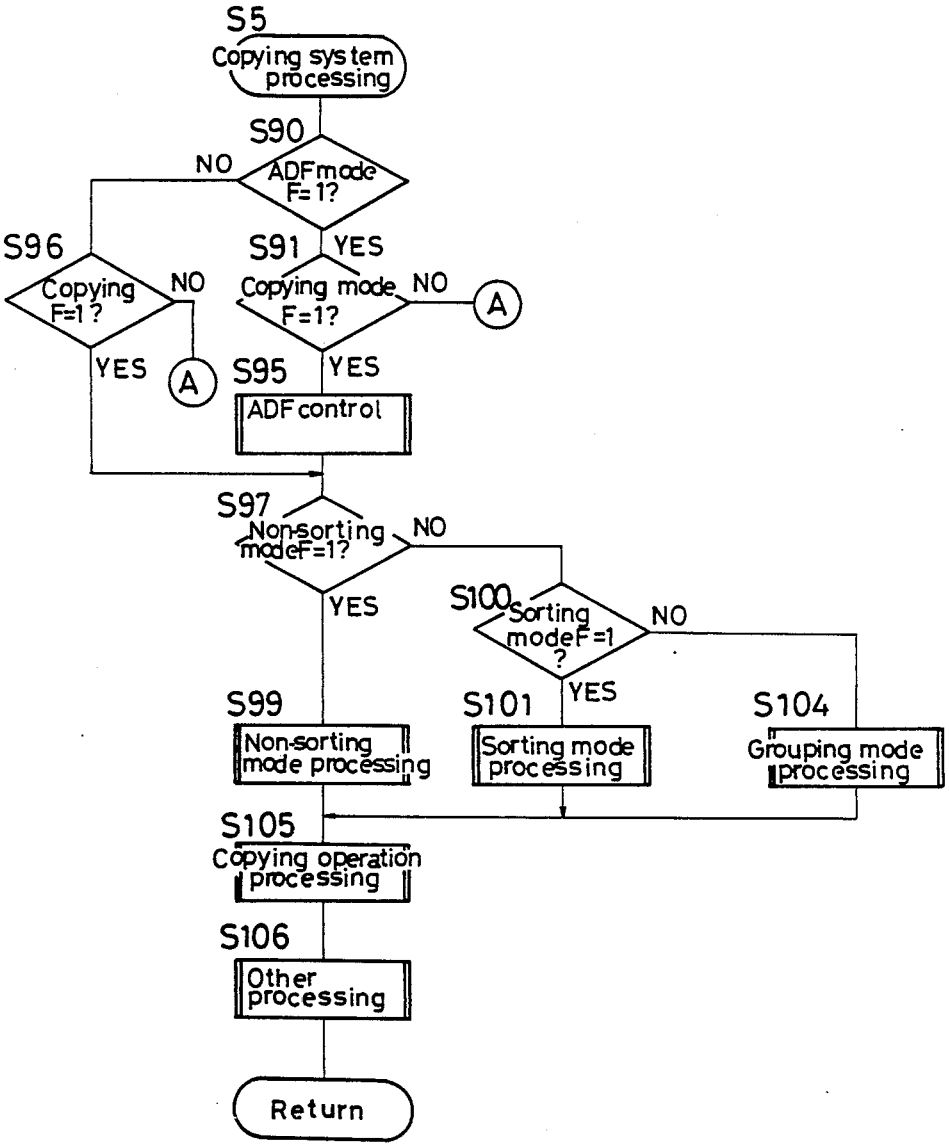
FIG. 24 is a flow chart showing a subroutine for the copying system processing.

FIG. 24 shows a subroutine for the processing of copying system to be executed at step S5 of the main routine.

First, whether the ADF mode flag is set to "1" or not is checked at step S90. When set to "1", whether the copying flag is set to "1" or not is checked at step S91. Since the copying operation is allowed when the copying flag is set to "1", a subroutine for the control of ADF 30 is executed at step S95, and the processing goes to step S97. When the ADF mode flag is judged to be reset to "0" at said step S90, whether the copying flag is set to "1" or not is checked at step S96. When set to "1", the processing goes to step S97. When the copying flag is judged to be reset to "0" at steps S91 and S96 respectively, the processing returns to the main routine.

When the non-sorting mode flag and the sorting mode flag are verified to be set to "1" at steps S97 and S100 respectively, subroutines for the non-sorting mode processing and sorting mode processing can be executed at steps S99 and S101 respectively.

On the other hand, when the non-sorting mode flag and the sorting mode flag are verified to be reset to "0" at steps S97 and S100, a subroutine for the grouping mode processing can be executed at step S104.

Further, a subroutine for the copying operation is executed at step S105, and a subroutine for other processing is executed at step S106.

The subroutines to be executed at said steps S99 and S104 can be executed by the procedures similar to the conventional ones, so that the details of these procedures are omitted here.

Figure 25:
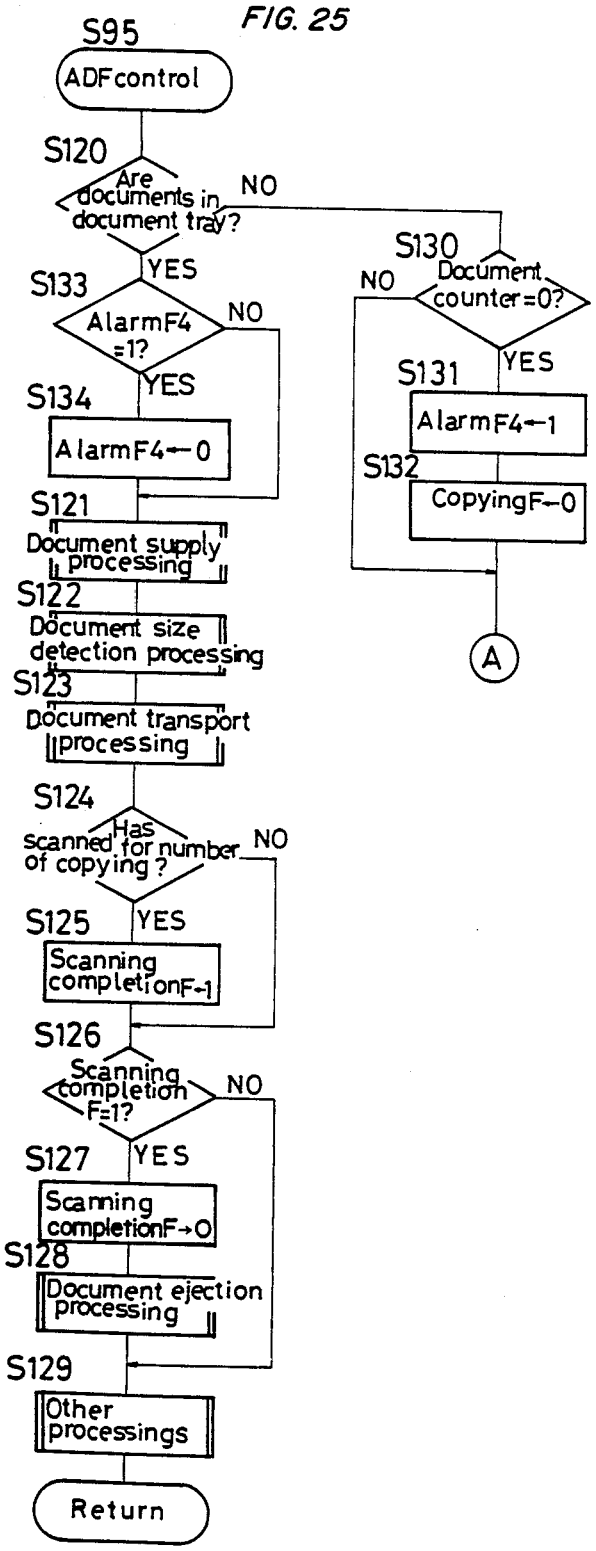
FIG. 25 is a flow chart showing a subroutine for the ADF control.
Figure 26A:
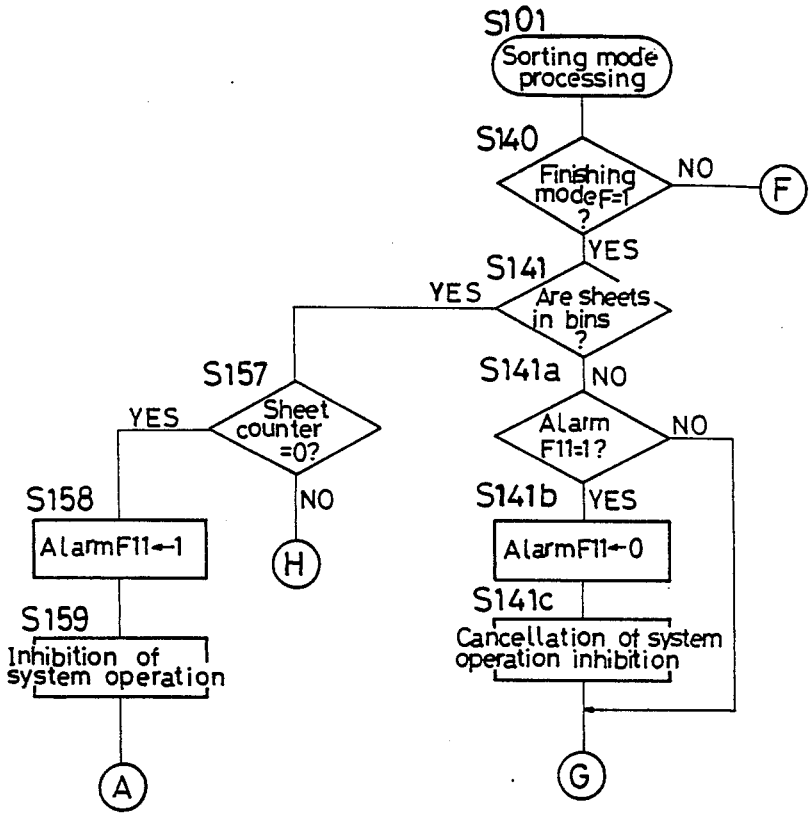
FIGS. 26*a*, 26*b*, 26*c* and 26*d* are flow charts showing a subroutine for the sorting mode processing.
Figure 26B:
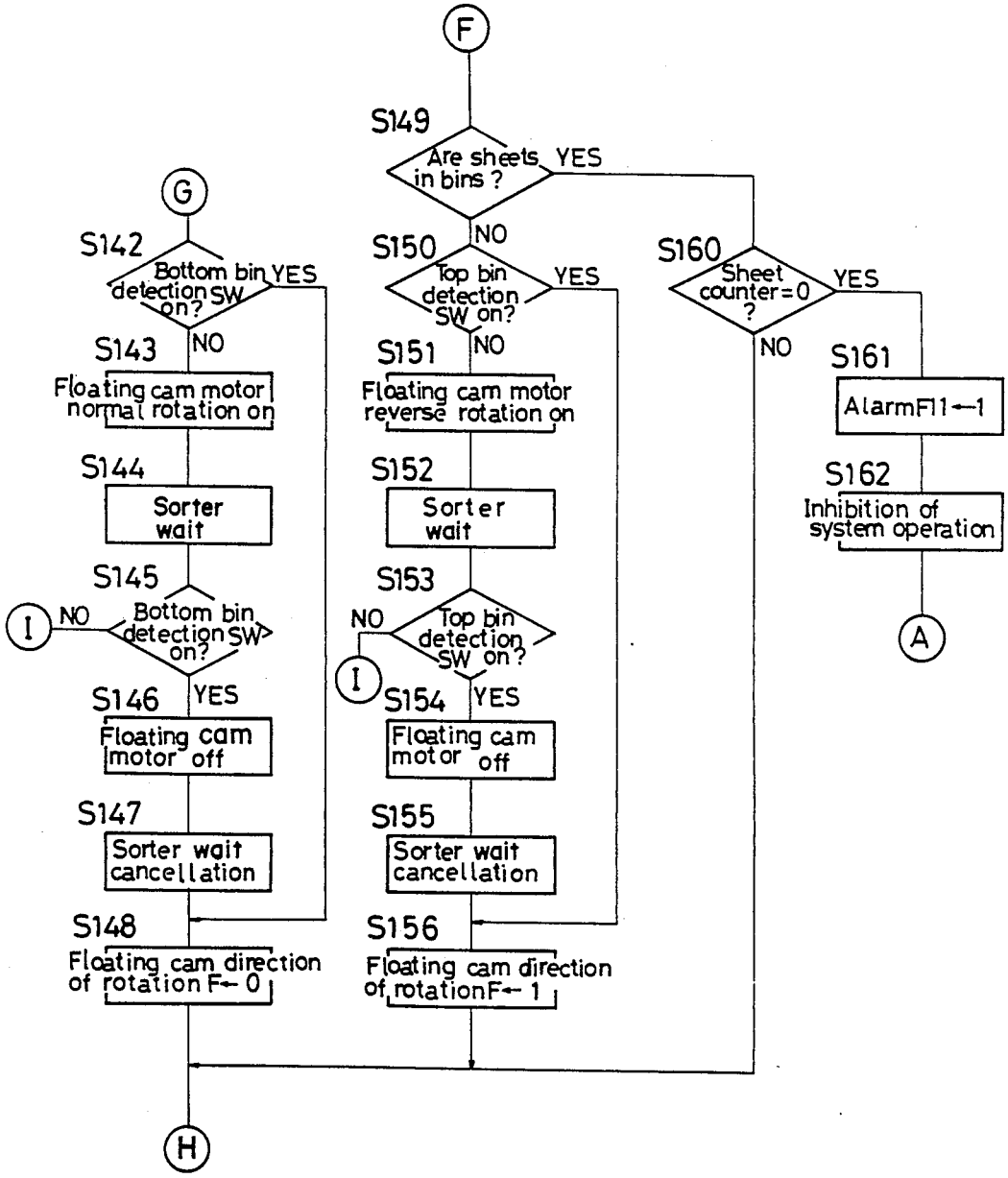
Figure 26C:
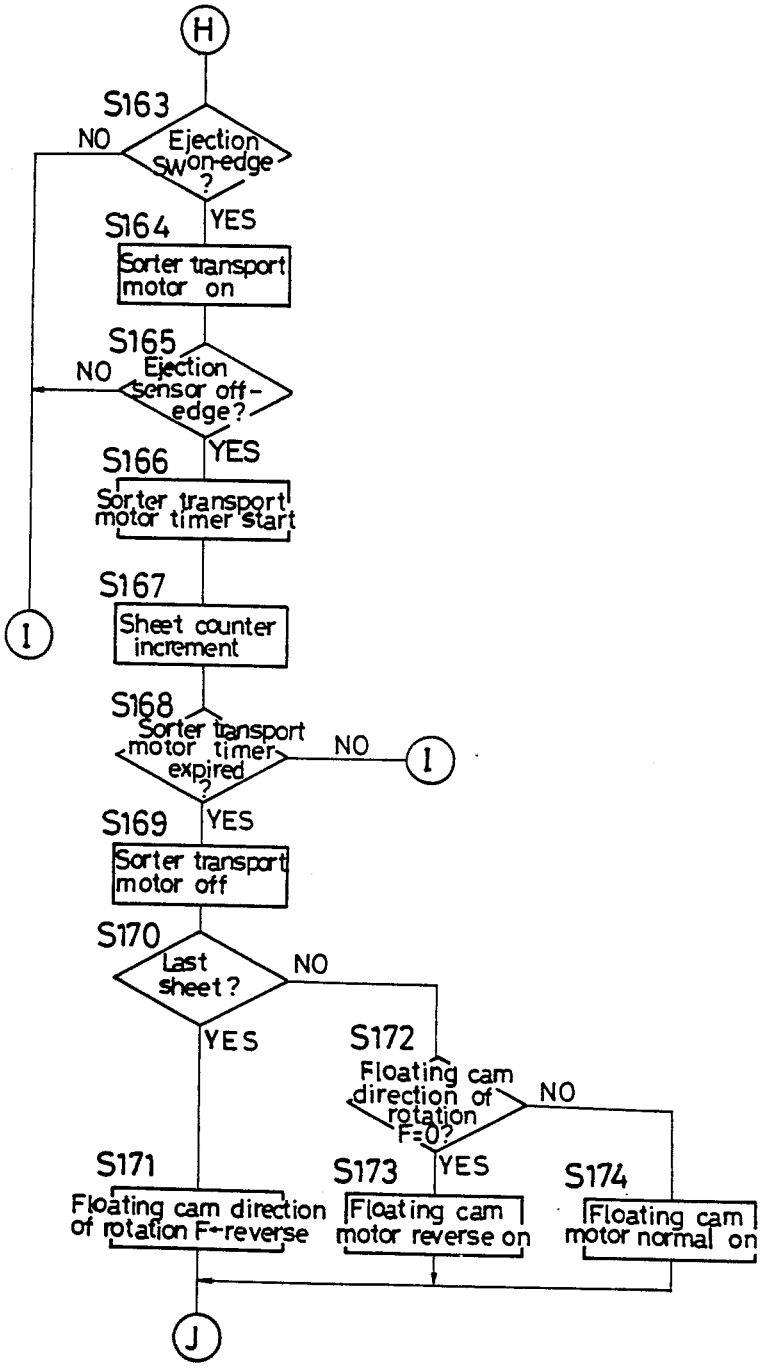
Figure 26D:
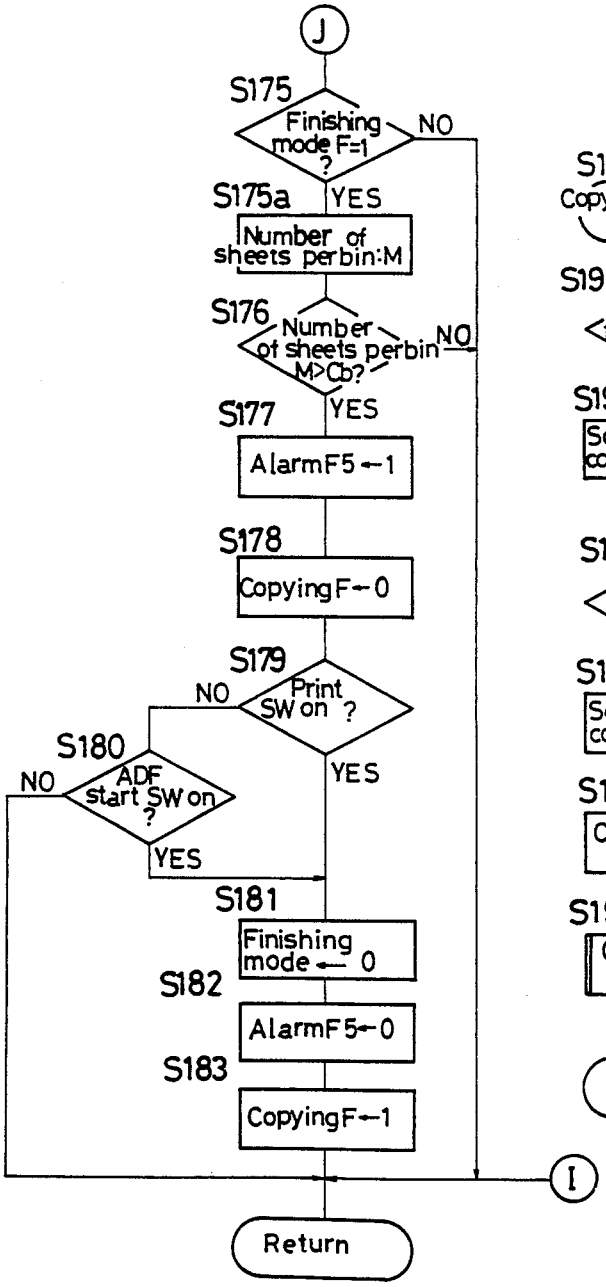

FIG. 25 shows a subroutine for the ADF control to be executed at said step S95.

First, whether the documents are present in document tray 31 or not is checked by on-off action of the sensor 37 at step S120. When the documents are present, whether the alarm flag F4 is set to "1" or not is checked at step S133. This flag F4 is set to "1" at step S131 which will be explained later, but, when the flag F4 is set to "1", it is reset to "0" at step S134. Then, document supply processing subroutine at step S121, document size detection processing subroutine at step S122 and document transport processing subroutine at step S123 are executed respectively.

On the other hand, when the documents have run out, whether the document counter registers "0" or not is checked at step S130. When "0" is registered, the alarm flag F4 is set to "1" at step S131, the copying flag is reset to "0" at step S132, and the processing returns to the main routine.

On the other hand, whether the optical unit 4 has scanned each copy for several minutes or not is checked at step S124. When the result is "Yes", a scanning completion flag is set to "1" at step S125. Then, that the scanning completion flag is set to "1" is confirmed at step S126. The scanning completion flag is reset to "0" at step S127. Document ejection processing subroutine is executed at step S128. Subroutines for other processings are executed at step S129.

Further, the ADF control subroutine is similar to the conventional one, so that the details of the subroutines to be executed at said steps S121, S123 and S128 are omitted here.

FIGS. 26*a* through 26*d* show a subroutine for the processing of sorting mode to be executed at said step S101. The subroutine differentiate the action of sorter bins 60 depending on whether the finishing mode is selected or not. This is because the order of distributing sheets to the bins 60 corresponds to the order of taking out the sheets from the bins 60, and such order are dependent on whether the finishing mode is selected or not. When the finishing mode is selected, the sheets are distributed first to the bottom bin 60 so that the sheet can readily be transported to stapling unit 90, and when not selected, the sheets are distributed first to the top bin 60 so that the operator can directly take out the sheets from the bins 60.

More particularly, whether the finishing mode flag is set to "1" or not is checked at step S140. When set to "1", whether the sheets are present or not in the bins 60 is checked by on-off action of the sensor Se5 at step S141. When the sheets are absent, whether alarm flag F11 is set to "1" or not is checked at step S141*a*. This alarm flag F11 is set to "1" at steps S153 and S161 which will be explained later, but, when the alarm flag F11 has been set to "1", it is reset to "0" at step S141*b*, and the inhibition of system operation is cancelled at step S141*c*. Then, whether the bottom bin detection switch SW1 is turned on or not, that is, whether or not the bins 60 are at the bottom bin position X1, the home position of the bins 60 when the finishing mode is selected, and whether the distribution of the sheets in the finishing mode is possible are checked at step S142. Thus, when the result of the check is "Yes", the processing goes to step S148, and the direction-of-rotation flag is reset to "0" in order to reverse the action of the bin for the sorting operation or to reverse the rotation of floating cam motor (not shown in the drawing). When the result of the check is "No" at step S142, the processings at steps S143 through S147 are executed to shift the bins 60 to the bottom bin position X1. That is, the floating cam motor is made to turn towards its normal direction at step S143, and sorter wait is applied at step S144. The sorter wait means the processing to inhibit the copying operation so that the sheets will not be fed to the sorting unit 41 while the bins 60 is in motion. When that the bottom bin detection switch SW1 is turned on is confirmed at step S145, the floating cam motor is turned off at step S146. The sorter wait is cancelled at step S147. The direction-of-rotation flag for the floating cam 50 is reset to "0" at step S148 in order to reverse the direction of rotation of the floating cam 50 from said step on.

On the other hand, when the finishing mode is not selected, whether the sheets are present or absent in the bins 60 is checked by on or off of the sensor Se5 at step S149. When the sheets are absent, whether the top bin detection switch SW2 is turned on or not at step S150, that is, whether or not the bin 60 is at the top bin position X2, the home position at the time of the finishing mode, and whether the distribution of the sheets in the finishing mode is possible or not are checked. Thus, when the result of the check is "Yes", the processing proceeds to step S156, and the direction-of-rotation flag for floating cam 50 is set to "1" to permit the normal rotation of floating cam 50. When said result is "No", the processings at steps S151 through S155 are executed to shift the bins 60 to the top bin position X2. That, is, the rotation of the floating cam 50 is reversed at step S151; the sorter wait is applied at step S152; that the top bin detection switch SW2 is turned on is confirmed at step S153; and the motor of the floating cam 50 is turned off at step S154. Subsequently, the sorter wait is cancelled at step S155. The direction-of-rotation flag for the floating cam 50 is set to "1" at step S156 to let the floating cam 50 rotate towards its normal direction from said step on.

Further, when the presence of the sheets in the bins 60 is detected at said steps S141 and S149, whether the sheet counter registers "0" or not is checked at steps S157 and S160. When found to be "0", the alarm flag F11 is set to "1" at steps S158 and S161 in order to prepare for lighting LED 160 for indicating the need of the removal of the sheets. The system operation is inhibited at steps S159 and S162, and the processing returns to the main routine.

Then, whether the ejection switch SW3 of the copying machine 1 is on-edge or not is checked at step S163. That is, when the end of the sheet has arrived to the ejection switch SW3, the sorter transport motor is turned on at step S164, and whether the sorter ejection sensor Se1 is off-edge or not is checked at step S165. More particularly, the sheet is judged to have distributed to the bin 60 when the rear end of the sheet has passed the ejection sensor Se1. When the ejection sensor Se1 is off-edge, the timer of the sorter transport motor is started at step S166. The number of sheets to be counted is increased at step S167. When the time set by the timer of the sorter transport motor has passed at step S168, the sorter transport motor is turned off at step S169. Subsequently, whether the sheet transported last is the last sheet or not is checked at step S170. When found to be the last sheet, the direction-of-rotation flag for the floating cam 50 is reversed at step S171. That is, when the direction-of-rotation flag for the floating cam 50 has been set to "0", it is set to "1", and it is reset to "0" when it has been set to "1" . When said sheet is not the last sheet is judged at step S170, the position of the direction-of-rotation flag for the floating cam 50 is checked at step S172 in order to continue the sorting operation. When said position is found to be "0", the rotation of the floating cam motor is reversed at step S173, and, when said position is found to be "1", the rotation of said motor is normalized at step S174. More particularly, the sheets are distributed by moving them up and down from the bottom bin 60 to the top bin 60 or from the top bin 60 to the bottom bin 60.

Then, whether the finishing mode flag is set to "1" or not is checked at step S175. When set to "1", the number M of the sheets for each bin 60 is calculated at step **S175*a*, and the number M of the sheets per bin and the allowable number Cb of sheets for stapling (refer to step S53) are compared at step S176. When the number M of sheets per bin is larger than the allowable number Cb of sheets for stapling, the alarm flag F5 is set to "1" at step S177 in order to prevent the defective stapling, and the preparation is made for indicating that the number M of sheets is too large for the capacity of the stapling unit 90. The copying flag is reset to "0" at step S178. Whether the print switch 121 is turned on or not is checked at step S179. Whether the ADF start switch 141 is turned on or not is checked at step S180. When either one of said print switch 121 or said ADF start switch 141 is turned on, that is, when the operator's will for the execution of the copying operation regardless of the alarm is confirmed, the finishing mode flag is reset to "0" at step S181; the alarm flag F5 is reset to "0" at step S182; and the copying flag is set to "1" at step S183** for enabling the execution of the processing in the sorting mode so that this subroutine can be completed.

When the operator wants to terminate the copying operation and execute the finishing processing when the alarm for the oversupply of the sheets for the capacity of the stapling unit 90 during the execution of the processing at steps S176 and S177, the operator is required only to turn on the finish start switch 158 (Refer to steps S206, S207).

Figure 27:
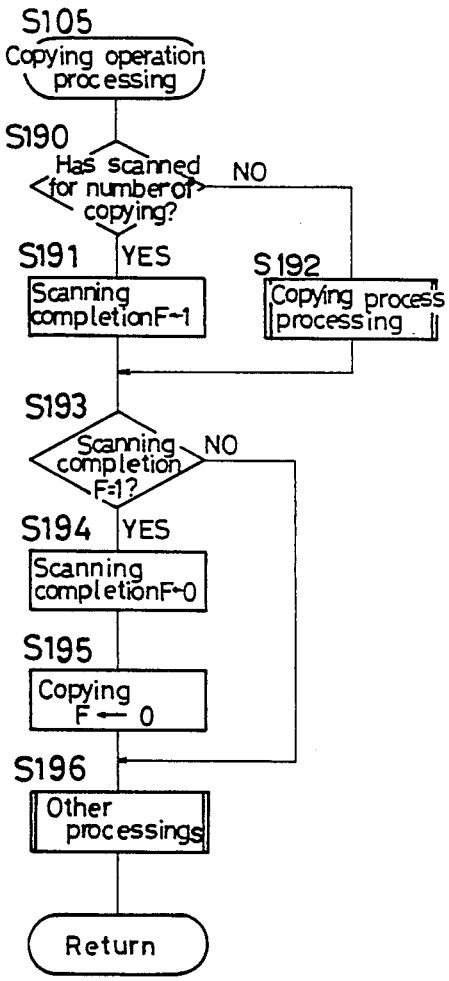
FIG. 27 is a flow chart showing a subroutine for the copying operation processing.

FIG. 27 shows a subroutine for the copying operation processing to be executed at said step S105.

First, whether the optical unit 4 has scanned each copy for several minutes or not is checked at step S190. When this result is "Yes", the scanning completion flag is set to "1" at step S191. When the result is "No", a subroutine for the processing of copying process is executed at step S192. This subroutine is designed for the execution of the ordinary copy process by the copying machine 1. The details of this subroutine are omitted here.

Then, after confirming that the scanning completion flag is set to "1" at step S193, the scaning completion flag is reset to "0" at step S194; the copying flag is reset to "0" at step S195; and the subroutines for other processings are executed at step S196.

FIGS. **28*a*, 28*b* show a subroutine the the finishing processing to be executed at step S6** of the main routine.

First, whether the finishing mode flag is set to "1" or not is checked at step S200. When set to "0", the processing is terminated at once. When set to "1", whether the off-line stapling flag is set to "1" or not is checked at step S201. When set to "1", a finishing mode inhibition flag is set to "1" at step **S201*a* in order to prepare for inhibition the operation in the finishing mode, and the processing is terminated at once. When the off-line stapling flag is reset to "0", whether the finishing mode inhibition flag is set to "1" or not is checked at step S202. When reset to "0", the processing goes to step S207. When set to "1", the presence or absence of the sheets on the staple tray 91 is checked by on-off action of the sheet detection sensor Se6 on staple tray 91 at step S203. When the presence of the sheets on the tray 91 is detected from that the sheet detection sensor Se6 is on, the alarm flag F6 is set to "1" at step S203*a* in order to prepare for indicating the necessity of removing the sheets from the staple tray 91 so that the troubles such as the mixing of the sheets already on the staple tray 91 with the sheets transported later onto the staple tray 91 and the oversupplying of the sheets for the capacity of stapling unit 90** can be prevented.

On the other hand, that the sheets are not present on the staple tray 91 is confirmed at step S203, the finishing mode inhibition flag is reset to "0" at step S204, in order to cancel the inhibition of the finishing mode operation. Next, whether the alarm flag F6 is set to "1" or not is checked at step S205. When set to "1", the flag F6 is reset to "0" at step S206, when reset to "0", the processing goes to step S207. At step S207, whether the finishing start switch 158 is changed to on from off or not is checked. When changed to on, the finishing processing flag is reset to "0" or not is checked at step S208. When reset to "0", that is, the switch 158 has been turned to on to select the finishing mode, and whether the ADF 30 is in operation or not is checked at S208*a*. When the ADF 30 is not in operation, the finishing processing flag is set to "1" at step S208*b*, when the ADF 30 is in operation, the finishing processing flag is reset to "0" at step S208*c*, and the processing goes to step S208*d*. When the result is "No" at said step S207, the processing goes to step S208*d*.

Next, whether or not a timer flag is reset to "0" is checked at step S208*d*. When the timer flag is reset to "0", a judgement is made at step S208*e* as to whether or not the ADF mode flag is set to "1" . When the ADF mode flag is set to "1", a judgment is made at step S208*f* as to whether or not all the documents have been fed from the document tray 31. When no document exists on the document tray 31, a timer Te is started at step S208*g*, and then the timer flag is set to "1" at step S208*h*. Further, when the judgement is negative at each of the above steps S208*d*, S208*e* and S208*f*, step S208*i* follows.

At step S208*i*, a judgement is made as to whether or not the timer Te has counted a specified time T5. when the timer Te has counted a specified time T5, the timer flag is reset to "0" at step S208*j*, and the finishing processing flag is then set to "1" at step S208*k* to execute the finishing processing at the next step. More specifically, in the case of a copying operation executed by using the ADF 30, even if the switch 158 is not turned to the on position, when a specified time T5 has passed after all the documents were fed from the tray 31, the finishing mode operation is started. further, the specified time T5, for example, corresponds to the time spent until the last document has been copied and sorted.

Subsequently, at step S209, the number of sheets per bin is calculated. At step S210, whether said number M of sheets is "1" or not is checked. More particularly, when one sheet distributed to each of bins 60, there is no need of stapling. Thus, when the number M of sheets per bin is found to be "1" at step S208, the alarm flag F3 is set to "1" at step S210*a* in order to prepare for indicating that the finishing mode is impossible, the finishing mode flag and the finishing processing flag are reset to "0" at steps S210*a* and S210*c* to cancel the finishing mode, and the subroutine is terminated.

When the number M of sheets per bin is not "1", whether the alarm flag F3 is set to "1" or not is checked at step S211. When set to "1", the flag F3 is reset to "0" at step S212. Then, whether the sheets are present or not on the staple tray 91 is checked again by on-off action of the sensor Se6 at step S213. When the sheets are present, the processings at steps S213*a*, S213*b* and S213*c* are executed not only for giving alarm but also for cancelling the finishing mode so that the troubles such as stapling unnecessary sheets and defective stapling as are described previously.

That is, the alarm flag F6 is set to "1" at step S213*a*, the finishing mode inhibition flag is set to "1" at step S213*b*, the finishing processing flag is reset to "0" at step S213*c*, and the subroutine is terminated. On the other hand, when the sheets are absent on the staple tray 91, whether the finishing processing flag is set to "1" or not is checked at step S214. When set to "1", and only in such case, the finishing processing may be executed. That is, a subroutine for the bin transport processing is executed at step S215, a subroutine for the sheet takeout processing at step S216, and a subroutine for staple processing at step S217 respectively. Then, when these processings have been completed, the presence or absence of the sheets in each of bins 60 is checked at step S218 and the presence or absence on the stable tray 91 is checked at step S219. When both the sheets are absent, the finishing processing flag is reset to "0" at step S217.

Further, in the case of said finishing processing subroutine, that the sheets have been removed from the staple tray 91 has to be confirmed at step S203, and then the alarm flag F6 has to be reset to "0" at step S206 to cancel the inhibition of the finishing mode. The finishing processing may be resumed automatically through the timer or by the input through the finishing start switch after cancelling the inhibition of the finishing mode.

More specifically, with this embodiment of the copying apparatus according to the present invention, the subroutine of the finishing processing is so arranged that, when the finishing mode is selected and when the switch 158 is turned to the on position, it is confirmed that no sheet exists on the staple tray 91, whereby the finishing processing is started. On the other hand, even if the switch 158 is not turned to the on position, when the timer Te has counted a specified time T5 after all documents have been fed from the document tray 31, the finishing processing is unconditionally executed. As a result of these arrangements in this embodiment, no operator is required to operate the switch 158, and, if only the proper mode is designated at the beginning of the copying operation, all the other procedures are automatically performed to staple the sheets individually which have undergone the copying operation.

Further, the time T5 designated with the above timer Te may vary in accordance with the number of duplicate sets. More specifically, with this subroutine, the time T5 is usually designated to correspond to a time to be spent obtaining ten sets of duplicates because the maximum number of bins among which the duplicate sheets can be distributed is 10. However, when the time T5 automatically varies in accordance with the number of sets of duplicates, if the number of sets of duplicates is smaller, only a short period of time is required to start the stapling operation.

Figure 29:
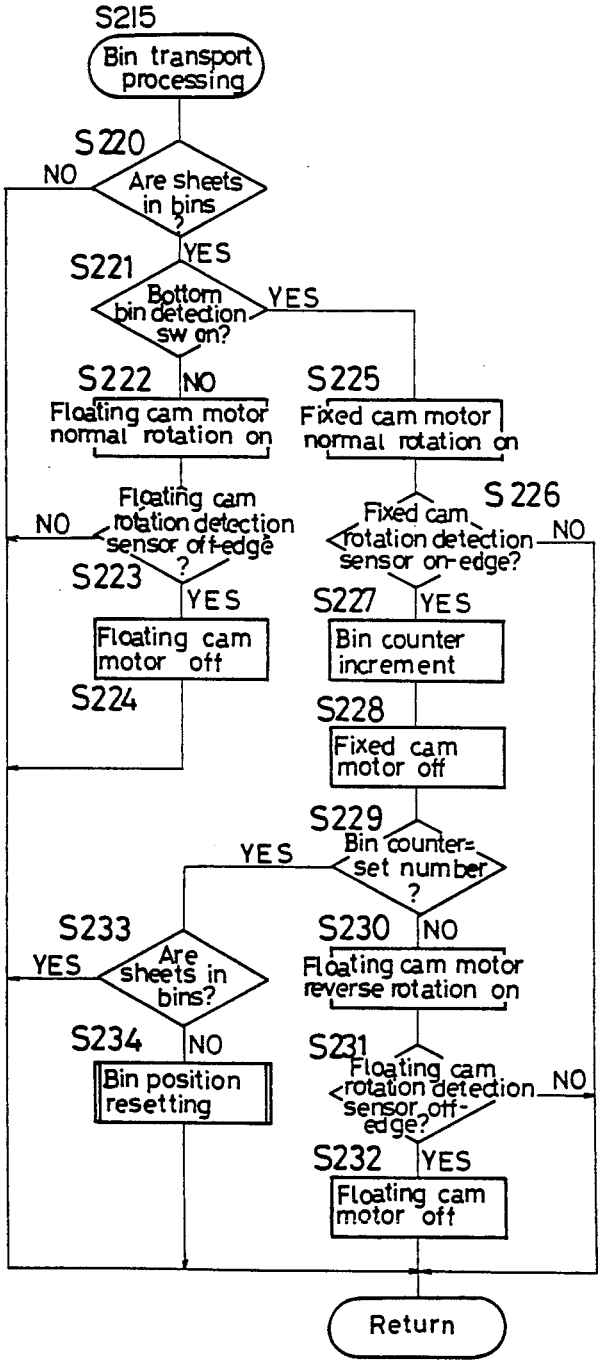
FIG. 29 is a flow chart showing a subroutine for the bin transport processing.

FIG. 29 shows a subroutine for the bin transport processing to be executed at said step S215.

The presence or absence of the sheets in bins 60 is checked by on-off action of the sensor Se5 at step S220, and the processing is terminated at once when the sheets are absent. Actually, such condition cannot occur, but it can occur when the operator takes out the sheets from the bins 60 immediately after completing the copying operation. When the sheets are present, they are detected by whether the bottom bin detection switch SW1 is on or not at step S221. When the switch SW1 is not on, the motor of the floating cam 50 is turned towards its normal direction at step S222 in order to shift the floating cam 50 to the bottom bin position X1, and said motor is turned off at step S224 when it is confirmed that a switch for detecting the rotation of the floating cam 50 is off-edge at step S223. The processings at steps S222, S223 and S224 will be continued until the floating cam 50 moves to the bottom bin position X1.

When the floating cam 50 has moved to the bottom bin position X1, that is, when the bottom bin detection switch SW1 is turned on at said step S221, the fixed cam motor is turned towards its normal direction at step S225, and whether the fixed cam rotation direction sensor Se2 is on-edge or not is checked at step S226. When sensor Se2 is on-edge, this indicates that the bin 60 at the bottom bin position X1 has descended to the sheet takeout position X3, and this is followed by the increment of the bin counter at step S227 and turning off of the fixed cam motor at step S228.

Then, whether the reading of the bin counter is equal to the set number A (Refer to step S10) or not is checked at step S229. When the reading of the bin counter is smaller than the set number A, the processing for letting the next bin 60 move to the sheet takeout position X3 is executed. That is, the rotation of the floating cam motor is reversed at step S230, and when the off-edge of the sensor for detecting the rotation of the floating cam motor is confirmed at step S231, the floating cam motor is turned off at step S232. This causes the next bin 60 to move to the bottom bin position X1. These steps S230, S231 and S232 will be repeated until the reading of the bin counter becomes equal to the set number A.

When the reading of the bin counter has become equal to the set number A, the stapling operation is completed, and a subroutine for resetting the bin position is executed at step S234 after confirming that the sheets are not present in the bins 60 at step S233.

Figure 30:
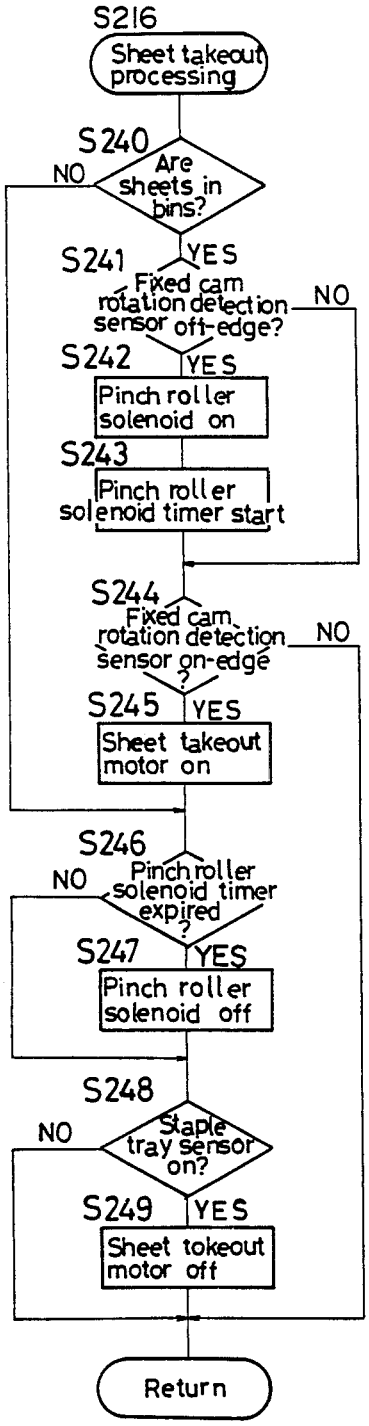
FIG. 30 is a flow chart showing a subroutine for the sheet takeout processing.

FIG. 30 shows a subroutine for the sheet takeout processing to be executed at said step S216. This subroutine is for the execution of the processing for transporting the sheet which have been brought down to the sheet takeout position X3 by the bins 60 to the staple tray 91 by the sheet transport unit 80.

First, whether the sheets are present in the bin 60 which is coming down to the sheet takeout position X3 or not is checked by the on-off action of the sensor Se5 at step S240. When the sheets are absent, the alarm is given (by the system not shown in the drawings), and the processing proceeds to step S246. When the presence of the sheet is confirmed, whether or not the fixed cam rotation detection sensor Se2 is off-edge, or whether the fixed cam 70 has started to turn towards its normal direction or not is checked at step S241. When found to be off-edge, or when the bin 60 has begun descent to the sheet takeout position X3 following the start of the normal rotation of the fixed cam 70, the solenoid of the pinch roller 76 is turned on at step S242, and the pinch roller solenoid timer is started at step S243. the sheets on the bin 60 is inserted between the takeout roller 75 and the pinch roller 76 at the sheet takeout position X3 when the sheet is caused to come down as the fixed cam 70 turns towards its normal direction.

Then, whether the fixed cam rotation direction sensor Se2 is on-edge or not, that is, whether the bin 60 has descended completely to the sheet takeout position X3, is checked at step S244. When found to be on-edge, the sheet takeout motor is turned on at step S245, and this causes the sheets to be transported to the staple tray 91 by the rollers 75, 76, 81*a* and 81*b*. When the expiration of the time set by the solenoid timer of pinch roller 76 is confirmed at step S246, the pinch roller solenoid is turned off at step S247. As a result, the pinch roller 76 withdraws upward away from the takeout roller 75. This is because the pinch roller 76 needs to move away from the sheet takeout position X3 before the next bin 60 starts to descend from the bottom bin position X1 so that the interference with the sheets distributed among the bins 60 can be prevented.

Then, the supply of the sheets to the staple tray 91 is confirmed by sensor Se6, which turns on when the sheets are supplied, at step S248, the sheet takeout motor is turned off at step S249 to terminate the execution of this subroutine.

Figure 31:
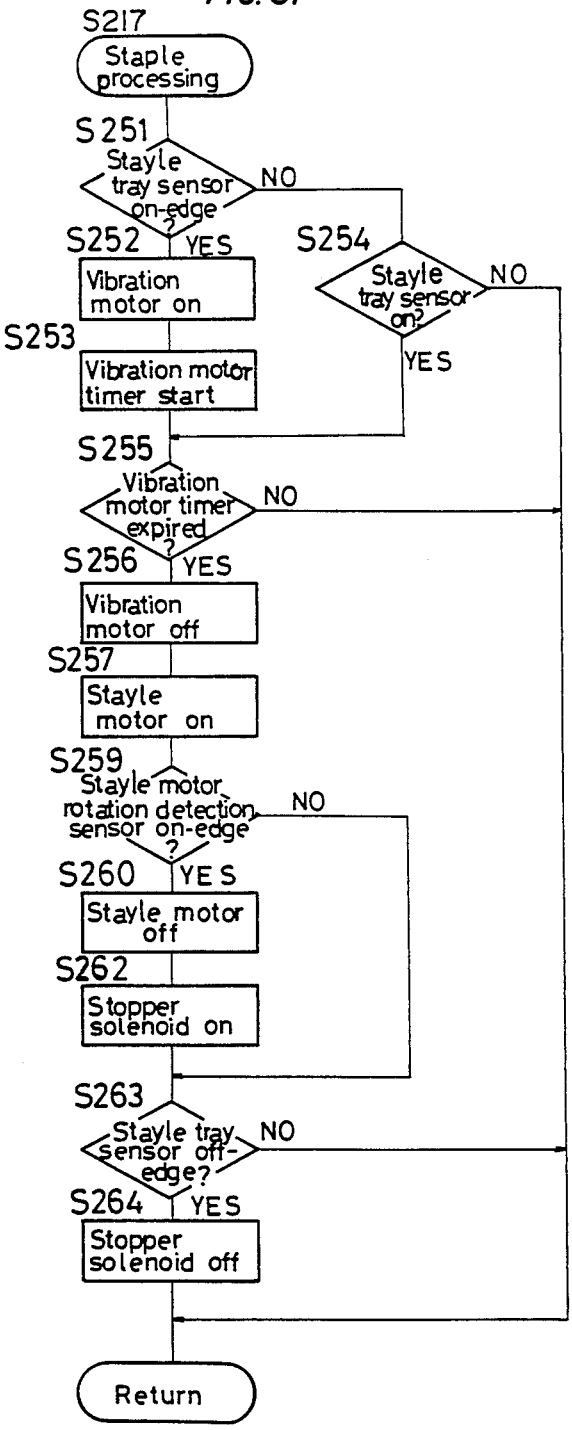
FIG. 31 is a flow chart showing a subroutine for the staple processing.

FIG. 31 shows a subroutine for staple processing to be executed at said step S217.

First, whether the sensor Se6 of the staple tray 91 is on-edge or not is checked at step S251. This sensor Se6 is turned on when the sheets are supplied onto the tray 91. Thus, when said sensor Se6 is on-edge, vibration motor 93 is turned on at step S252 in order to true up the sheets on the tray 91, and the timer of the vibration motor is started at step S253. On the other hand, when said sensor Se6 is found to be not on-edge at said step S251, and the sensor Se6 is on at step S254, or when the sheet on the tray 91 is detected, the processing proceeds to step S255.

Then, when the expiration of the time set by the timer of the vibration motor is confirmed at step S255, the vibration motor is turned off at step S256, and staple motor is turned on at step S257. Then, when the rotation detection sensor Se4 of the staple motor is found to be on-edge at step S259, or when the sheets are bound with staple 106 following the movement of the head 105, the stapling motor is turned off at step S260, and the stopper solenoid is turned on at step S262. This causes the stopper 96 to withdraw from above the tray 91, and the sheets slide downward onto stack tray 111.

Then, when the sensor Se6 of the staple tray 91 is found to be off-edge at step S263, or when the ejection of the sheets into the stack tray 111 is detected, stopper solenoid is turned off at step S264 to return the stopper 96 on the tray 91, and the execution of this subroutine is terminated.

Furthermore, the copying apparatus according to the present invention can be controlled by various procedures other than that described in the foregoing. Such other control procedures will be explained in the following.

Figure 28A:
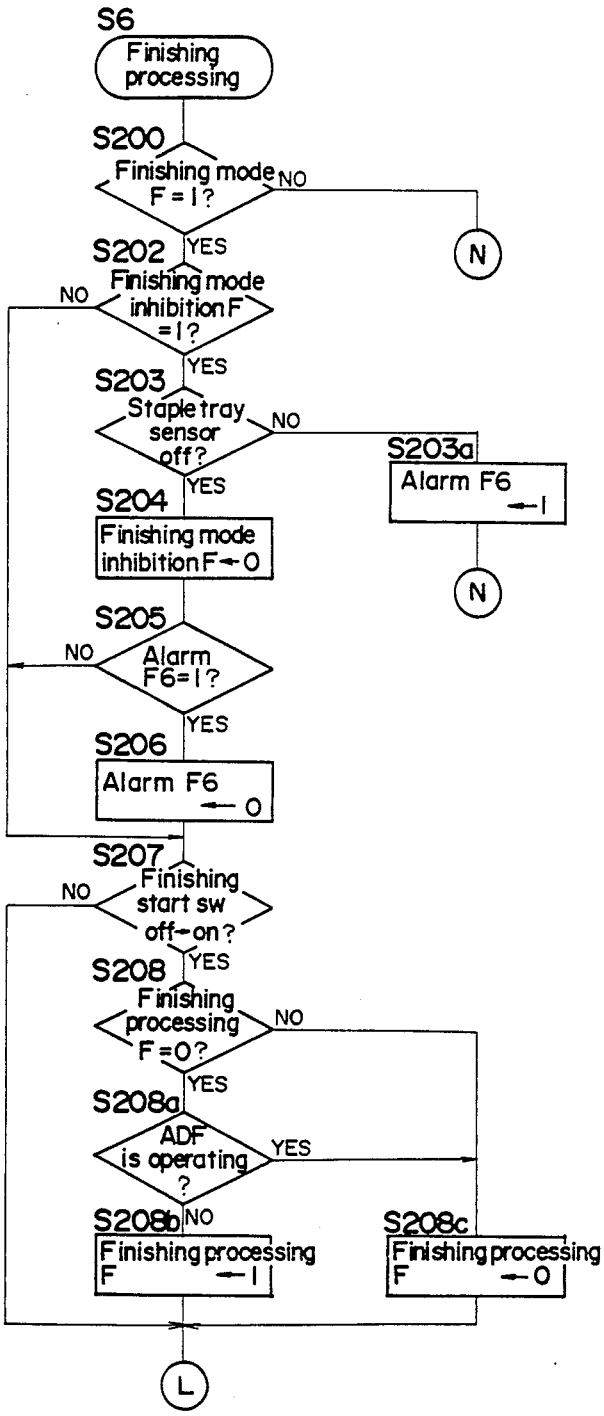
FIGS. 28*a*, 28*b* and 28*c* are flow charts showing a subroutine for the finishing processing.
Figure 28B:
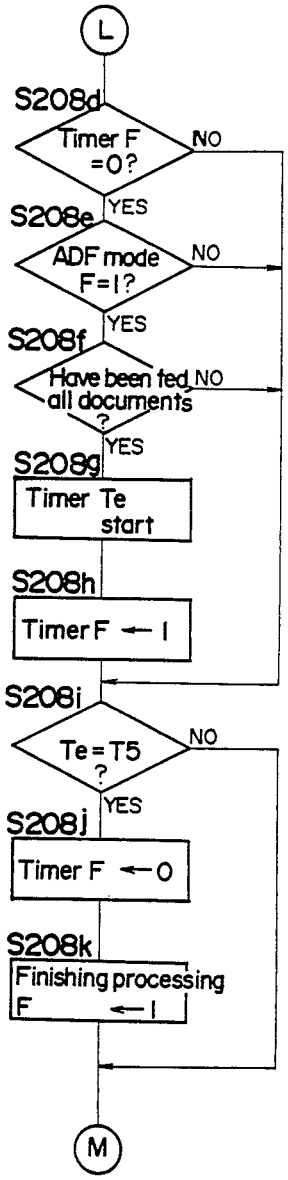
Figure 28C:
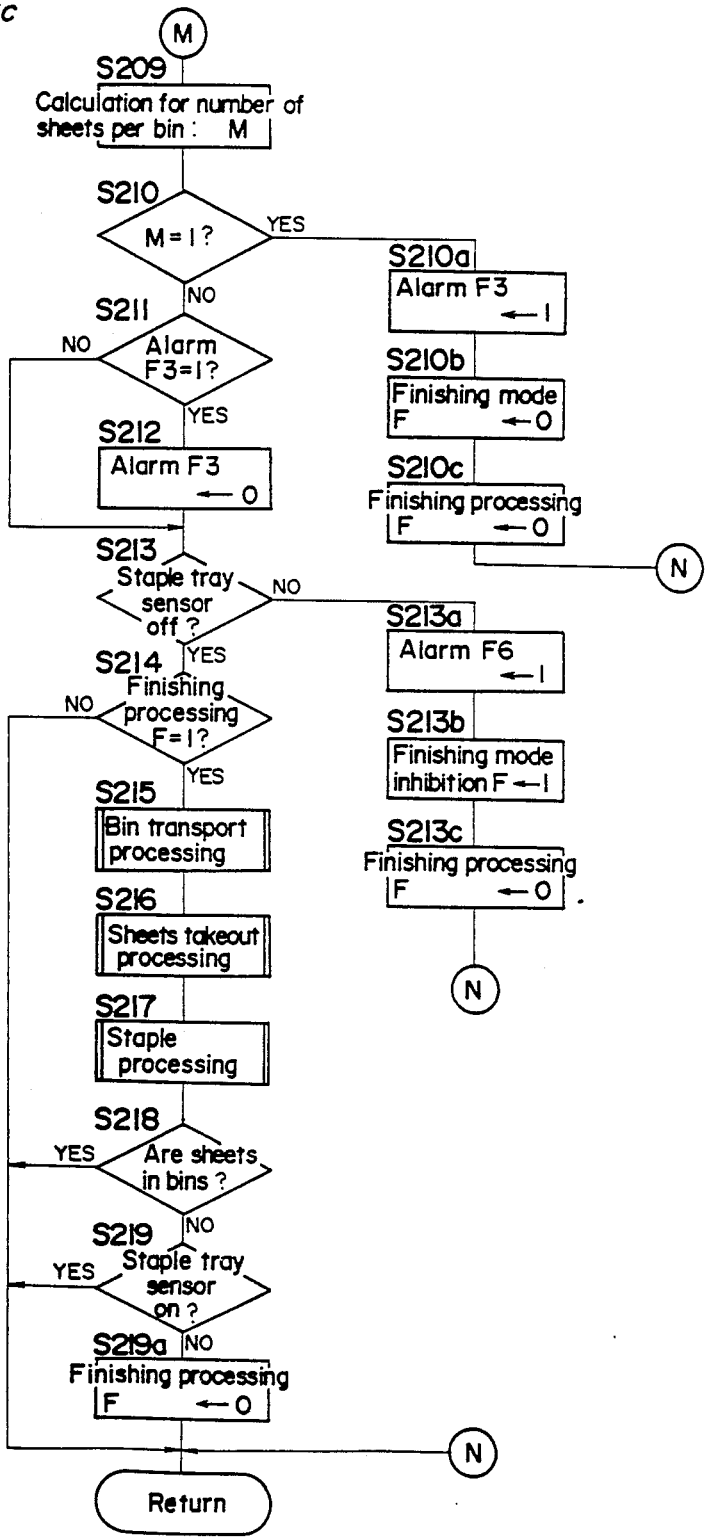
Figure 32A:
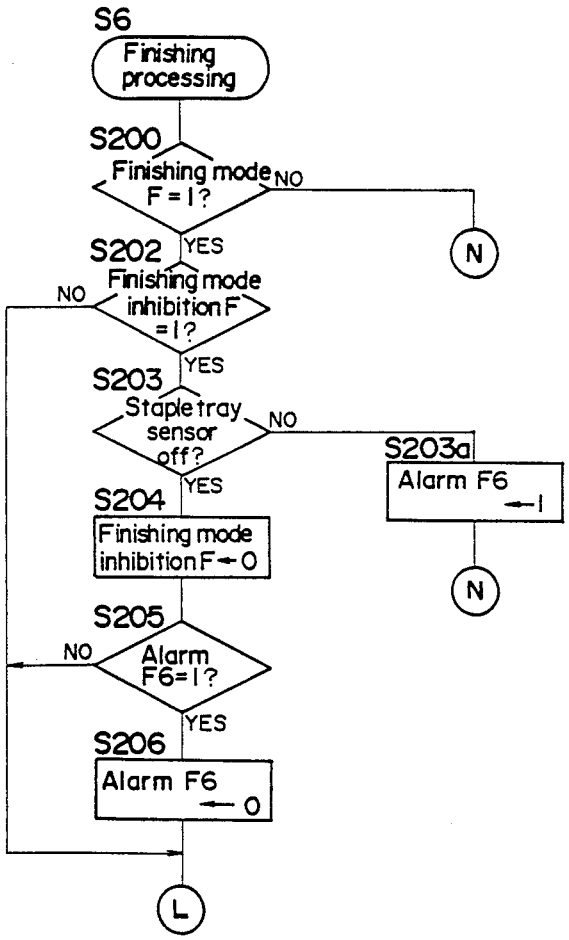
FIGS. 32*a* and 32*b* are flow charts showing a part of another subroutine for the finishing processing.
Figure 32B:
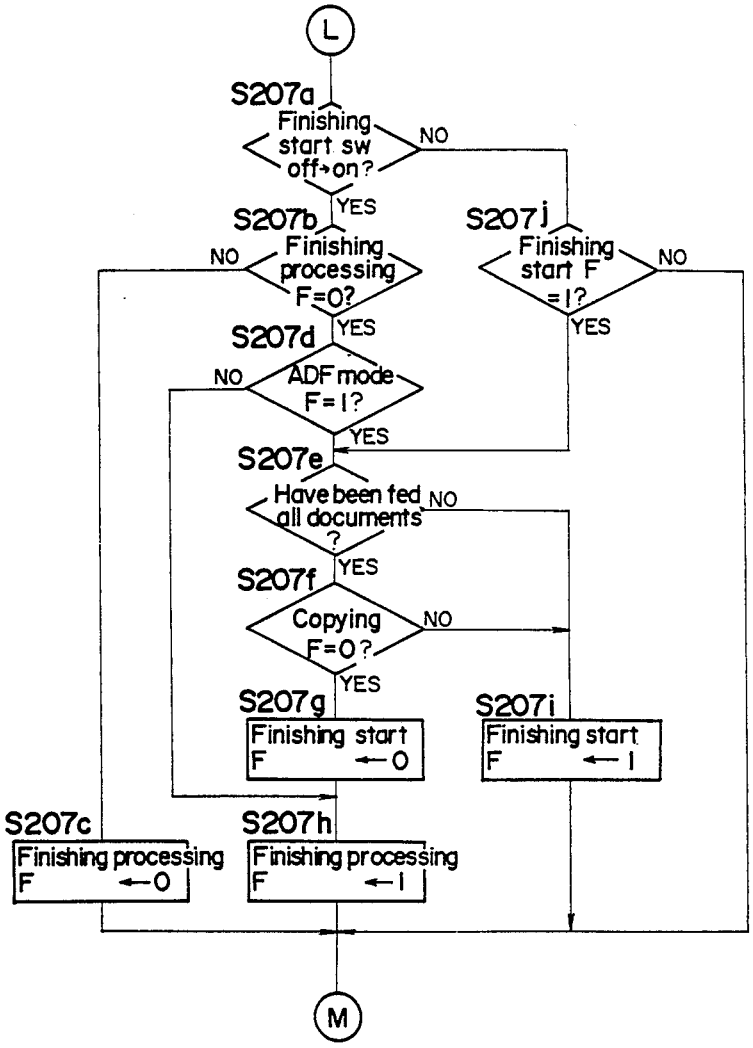

FIGS. 32*a* and 32*b* show a part of another subroutine for the finising processing, corresponds to said FIGS. 28*a* and 28*b*. Thus, the rest of the part of this subroutine is similar to the contents of said FIG. 28*c*.

In this subroutine, each steps S200–S206 are similar to the contents of said FIG. 28*a*. Therefore, when it is confirmed at step S207*a* that the finishing start switch 158 has changed from the OFF status to the ON status, a judgement is made at step S207*b* as to whether or not the finishing processing flag is set to "0" . When the finishing processing flag is set to "1", a similar flag is reset to "0" at step S207*c*. More specifically, when the finishing processing has already started, if the switch 158 is turned to the on position, the finishing processing is canceled. When the finishing processing flag is reset to "0", a judgement is made at step S207*d* as to whether or not the ADF mode flag is set to "1" . When the ADF mode flag is reset to "0", that is, the ADF 30 is not in use, the finishing processing flag is set to "1" at step S207*h*. When the ADF 30 is in use, that is, a judgement is affirmative at step S207*d*, whether or not all the documents have been fed from the document tray 31. When no document exists on the document tray 31, whether or not the copying flag is reset to "0" is checked at step S207*f*. When the copying flag is reset to "0", a finishing start flag is reset to "0" at step S207*g*, and the finishing processing flag is then set to "1" at step S207*h*. If there are any documents left on the document ray 31 or if the copying flag is set to "1", i.e. the copying operation is in progress, the finishing start flag is set to "1" at step S207*i*.

Contrarily, when it is checked in the above-mentioned step S207*a* that the switch 158 remains in the OFF status, whether or not the finishing start flag is set to "1" is checked at step S207*j*. When the finishing start flag is set to "1", step S207*e* follows. Then, even when the start switch 158 is in the ON status, only the finishing start flag is set to "1" at step S207*i* if the copying operation is in progress. This maintains the finishing processing flag at level "0" . Only when it is confirmed at step S207*f* that the entire copying operation has been completed will the finishing processing flag be set to "1" at step S207*h*, thus allowing the finishing processing to be executed.

More specifically, with this subroutine of the finishing processing is so arranged that, when the finishing mode is selected and when the switch 158 is turned to the on position, it is confirmed that no sheet exists on the staple tray 91, whereby the finishing processing is started.

On the other hand, even if the above switch 158 is turned to the on position, the finishing processing is never executed when the ADF 30 is in use and duplication of all the documents has not yet been completed. Only when duplication of all documents has been completed will the finishing processing start. As a result of this arrangement, it is possible to positively prevent the problem of erroneously executing the stapling operation before completing duplication of all the documents. In other words, if the switch 158 only is turned to the on position during the copying operation, the stapling operation is unconditionally executed as soon as the entire copying operation is completed, i.e. it is possible to pre-engage the stapling operation.

Although the present invention has been described in connection with the preferred embodiment thereof, it is to be noted that various changes and modifications are apparent to those skilled in the art. Such changes and modifications are to be understood as included within the scope of the present invention as defined by the appended claims, unless they depart therefrom.

What is claimed is:

1. A copying apparatus, comprising:

an automatic document feeder which includes a document tray for placing a plurality of documents thereon, means for feeding documents sheet by sheet from said document tray, and means for transporting a fed document to the exposure area and discharging the document having undergone image exposure from the exposure area;

image forming means for forming on copying sheets the image of a document fed to the exposure area;

sorting means for distributing copying sheets individually having an image formed thereon among a plurality of bins, whereby the sheets are stored;

means for binding the sheets contained in each bin;

means for detecting a document placed on said document tray;

a timer which starts when said detecting means confirms that all the documents have been fed from said document tray; and control means for starting the operation of said binding means in response to the completion of counting of said timer.

2. A copying apparatus claimed in claim 1 further comprising:

means for inputting the number of duplicate sets; and means for modifying the duration to be counted by said timer in accordance with the inputted number of duplicate sets.

3. A copying apparatus, comprising:

an automatic document feeder which includes a document tray for placing a plurality of documents thereon, means for feeding documents sheet by sheet from said document tray, and means for transporting a fed document to the exposure area and discharging the document having undergone image exposure from the exposure area;

image forming means for forming on copying sheets the image of a document fed to the exposure area;

sorting means for distributing copying sheets individually having an image formed thereon among a plurality of bins, whereby the sheets are stored;

means for binding the sheets contained in each bin;

means for inputting an instruction to start the operation of said binding means;

first control means for promptly starting the operation of said binding means when the instruction is inputted by said inputting means while said image forming means is not in operation; and second control means for starting the operation of said binding means after completing the operation of said image forming means when the instruction is inputted by said inputting means while said image forming means is in operation.

* * * * *